US007742712B2

(12) United States Patent
Izumi

(10) Patent No.: US 7,742,712 B2
(45) Date of Patent: Jun. 22, 2010

(54) TRANSFER BIAS VOLTAGE CONTROLLING APPARATUS

(75) Inventor: Takao Izumi, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 623 days.

(21) Appl. No.: 11/668,191

(22) Filed: Jan. 29, 2007

(65) Prior Publication Data

US 2008/0181636 A1 Jul. 31, 2008

(51) Int. Cl.
*G03G 15/00* (2006.01)
*G03G 15/16* (2006.01)

(52) U.S. Cl. ..... 399/44; 399/45; 399/66

(58) Field of Classification Search ..... 399/44, 399/45, 66
See application file for complete search history.

(56) References Cited

U.S. PATENT DOCUMENTS

| | | | | |
|---|---|---|---|---|
| 6,389,241 | B1 * | 5/2002 | Cernusak et al. | 399/44 |
| 7,013,105 | B2 * | 3/2006 | Omata | 399/45 |
| 7,095,968 | B2 * | 8/2006 | Akita et al. | 399/45 |
| 2007/0206970 | A1 | 9/2007 | Izumi et al. | |

FOREIGN PATENT DOCUMENTS

| | | |
|---|---|---|
| JP | 11-271037 | 10/1999 |
| JP | 2003-302208 | 10/2003 |

* cited by examiner

*Primary Examiner*—William J Royer
(74) *Attorney, Agent, or Firm*—Turocy & Watson, LLP

(57) ABSTRACT

In an image forming apparatus for transferring a toner image onto a sheet by applying a transfer bias voltage to the sheet through a transfer member, there is provided a technique of preventing poor transfer from occurring by suitably controlling the transfer bias voltage according to a processing condition.

20 Claims, 18 Drawing Sheets

| RELATIVE HUMIDITY(%) | SHEET CORRECTION VOLTAGE (V) |
|---|---|
| 20 | 1100 |
| 35 | 800 |
| 50 | 600 |
| 60 | 570 |
| 70 | 540 |
| 85 | 500 |

TRANSFER BIAS VOLTAGE CONTROLLING APPARATUS

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

BACKGROUND OF THE INVENTION

1. Field of the Invention

The present invention relates to a control technique of a transfer bias voltage in an image forming apparatus for transferring a toner image onto a sheet by applying the transfer bias voltage to the sheet through a transfer member.

2. Description of the Related Art

Hitherto, the determination of a processing condition of a transfer processing of a toner image onto a sheet has been performed such that a user selects the basis weight of a sheet to be used, a voltage value of a transfer bias voltage is determined based on the information, and transfer onto the sheet is performed. Besides, in order to save the user the trouble of selecting the sheet, after the thickness of the sheet is detected by a thickness detecting sensor or the like, the transfer bias voltage is determined and the transfer processing onto the sheet has been performed.

In general, in sheets of the same material, even if the basis weight or electric resistance is changed, a necessary transfer current is constant. Accordingly, when a transfer bias voltage by which a specified transfer current flows is applied according to the basis weight or electric resistance, an excellent image can be obtained. However, in sheets of different materials, even if the basis weights or electric resistances are almost the same, optimum transfer currents are not always coincident with each other, and poor transfer (poor image) can often occur.

The invention has been made to solve the foregoing problem, and has an object to provide a technique of preventing poor transfer from occurring by suitably controlling a transfer bias voltage according to a processing condition in an image forming apparatus in which a toner image is transferred onto a sheet by applying the transfer bias voltage to the sheet through a transfer member.

DETAILED DESCRIPTION OF THE INVENTION

Hereinafter, embodiments of the invention will be described with reference to the drawings.

Throughout this description, the embodiments and examples shown should be considered as exemplars, rather than limitations on the apparatus, methods and programs of the present invention.

First Embodiment

Figure 1:
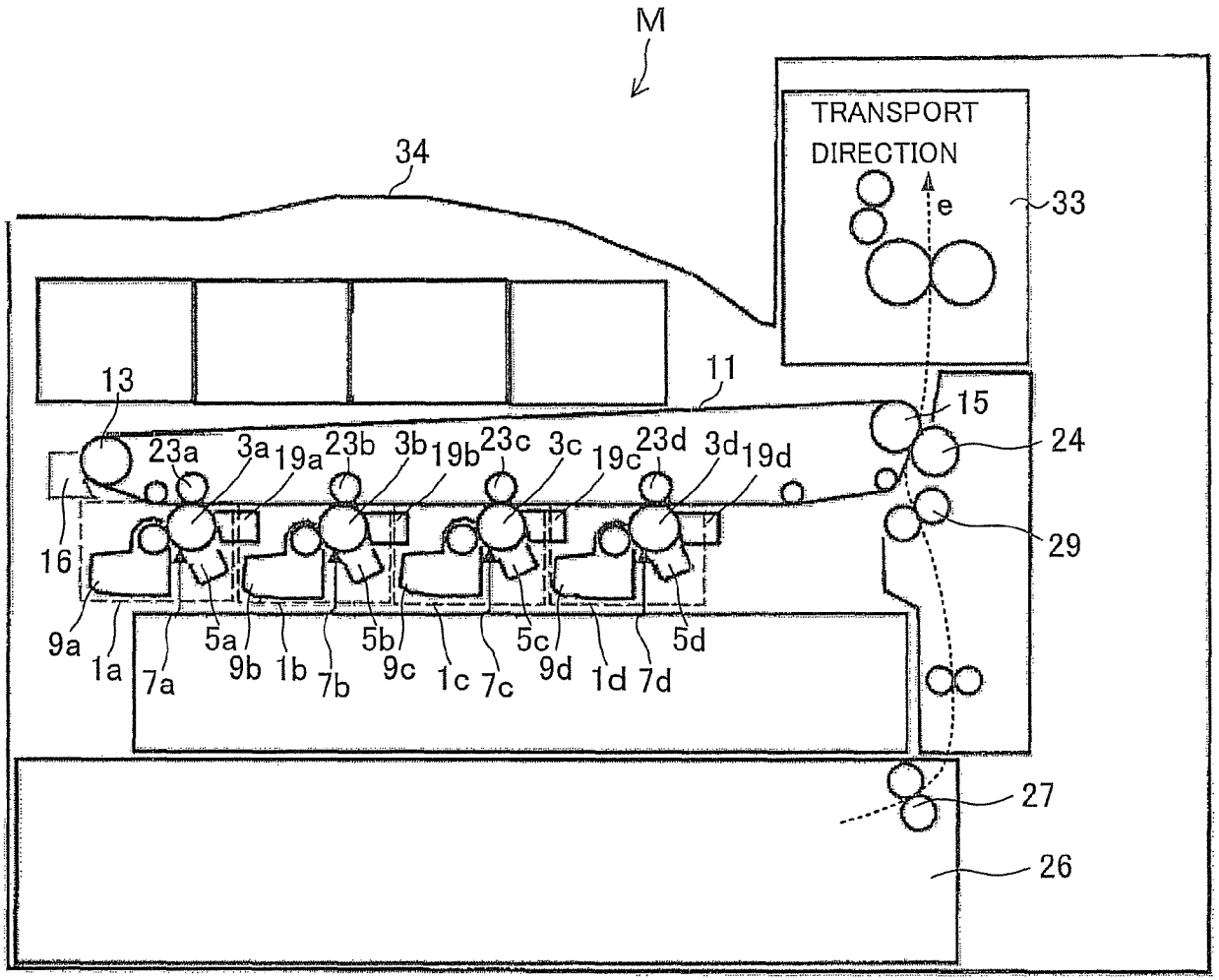
FIG. 1 is a longitudinal sectional view showing a schematic structure of an image forming apparatus according to a first embodiment of the invention.

FIG. 1 is a longitudinal sectional view showing a schematic structure of an image forming apparatus M according to a first embodiment of the invention.

As shown in the drawing, the image forming apparatus M is provided with process units 1*a*, 1*b*, 1*c* and 1*d* as image forming means. The respective process units include photoconductive drums (photoconductors) 3*a*, 3*b*, 3*c* and 3*d* as image bearing bodies, and developer images are formed on these photoconductors.

The process unit 1*a* will be described. In FIG. 1, the photoconductive drum 3*a* has a cylindrical shape with a diameter of 30 mm, and is provided to be rotatable in a clockwise direction in the drawing.

The following are provided around the photoconductive drum 3*a* along the rotation direction. First, a charging charger 5*a* is provided to be opposite to the surface of the photoconductive drum 1*a*. The charging charger 5*a* uniformly negatively (−) charges the photoconductive drum 3*a*. An exposure device 7*a* to expose the charged photoconductive drum 3*a* to form an electrostatic latent image is provided at the downstream side (right in FIG. 1) of the charging charger 5*a*. Besides, a developing unit 9*a* which contains an yellow developer and reversal-develops the electrostatic latent image, which has been formed by the exposure device 7*a*, with this developer is provided at the downstream side of the exposure device 7*a*. An intermediate transfer belt 11 as an image formed medium is provided to come in contact with the photoconductive drum 3*a*.

A cleaner 19*a* is provided at the downstream side of the contact position between the photoconductive drum 3*a* and the belt 11. After transfer, the cleaner 19*a* removes the surface charge of the photoconductive drum 3*a* by uniform light irradiation, and removes and receives residual toner on the photoconductive drum 3*a*. By this, one cycle of image formation is completed, and at a next image forming process, the charging charger 5*a* again uniformly charges the non-charged photoconductive drum 3*a*.

The process unit 1*a* includes the photoconductive drum 3*a*, the charging charger 5*a*, the exposure device 7*a*, the developing unit 9*a*, and the cleaner 19*a*.

The belt 11 has a length (width) almost equal to the length of the photoconductive drum 3*a* in a direction (depth direction of the drawing) perpendicular to a transport direction (direction of an arrow e shown in the drawing). This belt 11 has a shape of an endless (seamless) belt, and is supported on a drive roller 13 to rotate the belt 11 at a specified speed and some driven rollers.

The belt 11 is made of polyimide uniformly dispersed with carbon and having a thickness of 100 μm. This belt 11 has an electric resistance of $10^9$ Ωcm and exhibits semiconductivity.

As a material of the belt 11, any material may be used as long as it has a volume resistance value of $10^8$ to $10^{11}$ Ωcm and exhibits semiconductivity. For example, a material obtained by dispersing a conductive particle of carbon or the like into polyethylene terephthalate, polycarbonate, polytetrafluoroethylene, polyvinylidene fluoride or the like may be used in addition to the polyimide dispersed with carbon. The conductive particle is not used, but a high molecular film whose electric resistance is adjusted by composition adjustment may be used. Further, a material obtained by mixing an ion conductive material into such a high molecular film, or a rubber material, such as silicone rubber or urethane rubber, having relatively low electric resistance may be used.

The process units 1*b*, 1*c* and 1*d*, in addition to the process unit 1*a*, are arranged along the belt 11 between the drive roller 13 and a secondary transfer opposite roller 15 along the transport direction of the belt 11.

Each of the processing units 1*b*, 1*c* and 1*d* has the same structure as the process unit 1*a*. That is, the photoconductive drums 3*b*, 3*c*, and 3*d* are provided almost at the centers of the respective process units 1*b*, 1*c* and 1*d*. Charging chargers 5*b*, 5*c* and 5*d* are provided around the respective photoconductive drums 3*b*, 3*c*, and 3*d*. Exposure devices 7*b*, 7*c* and 7*d* are provided at downstream sides of the charging chargers 5*b*, 5*c*, and 5*d*. A structure in which developing units 9*b*, 9*c* and 9*d* and cleaners 19*b*, 19*c* and 19*d* are provided at downstream sides of the exposure devices 7*b*, 7*c*, and 7*d* is also similar to the process unit 1*a*. A difference is a developer contained in the developing units 19*b*, 19*c*, and 19*d*. The developing unit 19*b* contains a magenta developer, the developing unit 19*c* contains a cyan developer, and the developing unit 19*d* contains a black developer.

The belt 11 sequentially comes in contact with the respective photoconductive drums 3*a*, 3*b*, 3*c*, and 3*d*. In the vicinities of the contact positions between this belt 11 and the respective photoconductive drums 3*a*, 3*b*, 3*c*, and 3*d*, transfer devices 23*a*, 23*b*, 23*c* and 23*d* as transfer means are provided to correspond to the respective photoconductive drums 3*a*, 3*b*, 3*c*, and 3*d*. That is, the transfer devices 23*a*, 23*b*, 23*c*, and 23*d* is provided below the corresponding photoconductive drum 3*a*, 3*b*, 3*c*, and 3*d* to be in back contact with the belt 11 and is opposite to the process units 1*a*, 1*b*, 1*c*, and 1*d* through the belt 11.

The transfer member 23*a* is connected to a not-shown positive (+) DC power source as voltage application means. Similarly, the transfer members 23*b*, 23*c* and 23*d* are respectively connected to not-shown DC power sources.

On the other hand, in FIG. 1, a paper feed cassette 26 containing sheets is provided below the image forming unit. A pickup roller 27 to pick up the sheets one by one from the paper feed cassette 26 is provided in a main body of the image forming apparatus M. A register roller pair 29 is rotatably provided in the vicinity of a secondary transfer roller 24. The register roller pair 29 supplies the sheet at a specified timing to a secondary transfer unit where the secondary transfer roller 24 and the secondary transfer opposite roller 15 face each other through the belt 11.

Besides, a fixing unit 33 to fix the developer onto the sheet and an in-barrel paper discharge unit 34 to which the sheet fixed by this fixing unit 33 is discharged are provided at the front right of the belt 11.

Next, a color image forming operation of the image forming apparatus M constructed as described above will be described.

When the start of an image forming processing is instructed, the photoconductive drum 3*a* receives a drive force from a not-shown drive mechanism and starts to rotate. The charging charger 5*a* uniformly charges the photoconductive drum 3*a* to about −600 V. The exposure device 7*a* irradiates light corresponding to an image to be recorded to this photoconductive drum 3*a* uniformly charged by the charging charger 5*a* and forms an electrostatic latent image. The developing unit 9*a* contains the developer (yellow (Y) toner+ferrite carrier; two-component developer), a developing bias voltage value of −380 V is given to a not-shown developing sleeve by a not-shown developing bias power source, and a developing electric field is formed between the developing sleeve and the photoconductive drum 3*a*. Reversal development is performed in which the negatively charged Y toner is attached to an area of an image part potential (high potential part; signs are considered) of the electrostatic latent image on the photoconductive drum 3*a*. Next, by a method different from that in which the developing unit 9*a* forms the Y toner image on the photoconductive drum 3*a*, the developing unit 9*b* develops the electrostatic latent image with the magenta developer and forms a magenta toner (M toner) image on the photoconductive drum 3*b*. At this time, similarly to the Y toner, the M toner has an average particle diameter of about 7 microns and is negatively charged by friction charging with a ferrite magnetic carrier particle (not shown) with an average particle diameter of 60 microns. Similarly to the developing unit 3*a*, the developing bias voltage value is about −380 V and is applied to the developing sleeve (the structure of the developing unit 9*b* is the same as the developing unit 9*a*) by a not-shown bias power source. The direction of a developing electric field is directed from the surface of the photoconductive drum 3*b* toward the developing sleeve, and the negatively charged M toner is attached to a high potential part of the latent image.

In a transfer area including the photoconductive drum 3*a*, the belt 11 and the transfer device 23*a*, a bias voltage of about +1000 V is applied to the transfer device 23*a*. A transfer electric field is formed between the transfer device 23*a* and the photoconductive drum 3*a*, and the yellow toner image on the photoconductive drum 3*a* is transferred onto the belt 11 in accordance with this transfer electric field.

Next, a portion relating to the transfer device 23*a* will be described in more detail.

The transfer device 23*a* is a conductive urethane foam roller which is made conductive by dispersing carbon. A roller with an outer diameter of ϕ18 mm is formed on a cored bar of ϕ10 mm. An electric resistance between the cored bar and roller surface is about $10^6\Omega$. A constant voltage DC power source is connected to the cored bar.

A feeder device in the transfer device 23*a* may be a conductive brush, a conductive rubber blade, a conductive sheet or the like in addition to the roller. The conductive sheet is a rubber material dispersed with carbon or a resin film, and may be a rubber material such as silicone rubber, urethane rubber or EPDM, or a resin material such as polycarbonate. It is desirable that a volume resistance value is $10^5$ to $10^7$ Ωcm.

A spring and a spring as urging means are provided at both ends of a roller shaft, and by the springs, the transfer roller 23*a* is urged to come in elastic contact with the belt 11 in the vertical direction. The magnitude of the urging force by the spring and the spring provided to each of the transfer rollers is 600 gf. Here, the urging force means the sum of an urging force of 300 gf by the spring and an urging force of 300 gf by the spring.

The structures of the transfer devices 23*b*, 23*c* and 23*d* are similar to the transfer device 23*a*, and the structures of elastic contact with the belt 11 are also similar to each other with respect to the respective transfer devices 23*b*, 23*c* and 23*d*, and therefore, the explanation of the structures of the transfer devices 23*b*, 23*c* and 23*d* will be omitted.

An image on the belt 11 on which the Y (yellow) toner image is transferred in the transfer area is transported to a transfer area. In the transfer area, a bias voltage of about +1200 V is applied to the transfer device 23*b* from a DC power source, so that the magenta toner image is transferred to overlap with the Y toner image. A bias voltage of about +1400 V is applied to the transfer member 23*c* in a transfer area, and further, a voltage of about +1600 V is applied to the transfer device 23*d* in a transfer area, so that the cyan developer image and the black developer image are sequentially multiplex-transferred to overlap with the already transferred developer image. On the other hand, the pickup roller 27 takes out the sheet from the paper feed cassette 26, and the register roller pair 29 supplies this sheet to the secondary transfer unit.

In the secondary transfer unit, a specified transfer bias voltage is applied to the secondary transfer opposite roller 15, a transfer electric field is formed between the secondary transfer opposite roller 15 and the secondary transfer roller 24 through the belt 11, and the multiplex color toner images on the belt 11 are transferred onto the sheet at the same time. The secondary transfer opposite roller 15, the belt 11 and the secondary transfer roller 24 here are equivalent to a transfer member.

As stated above, the developer images of the respective colors transferred at the same time are fixed on the sheet P by the fixing unit 33, and a color image is formed. The fixed sheet P is discharged onto the in-barrel paper discharge unit 34.

Figure 2:
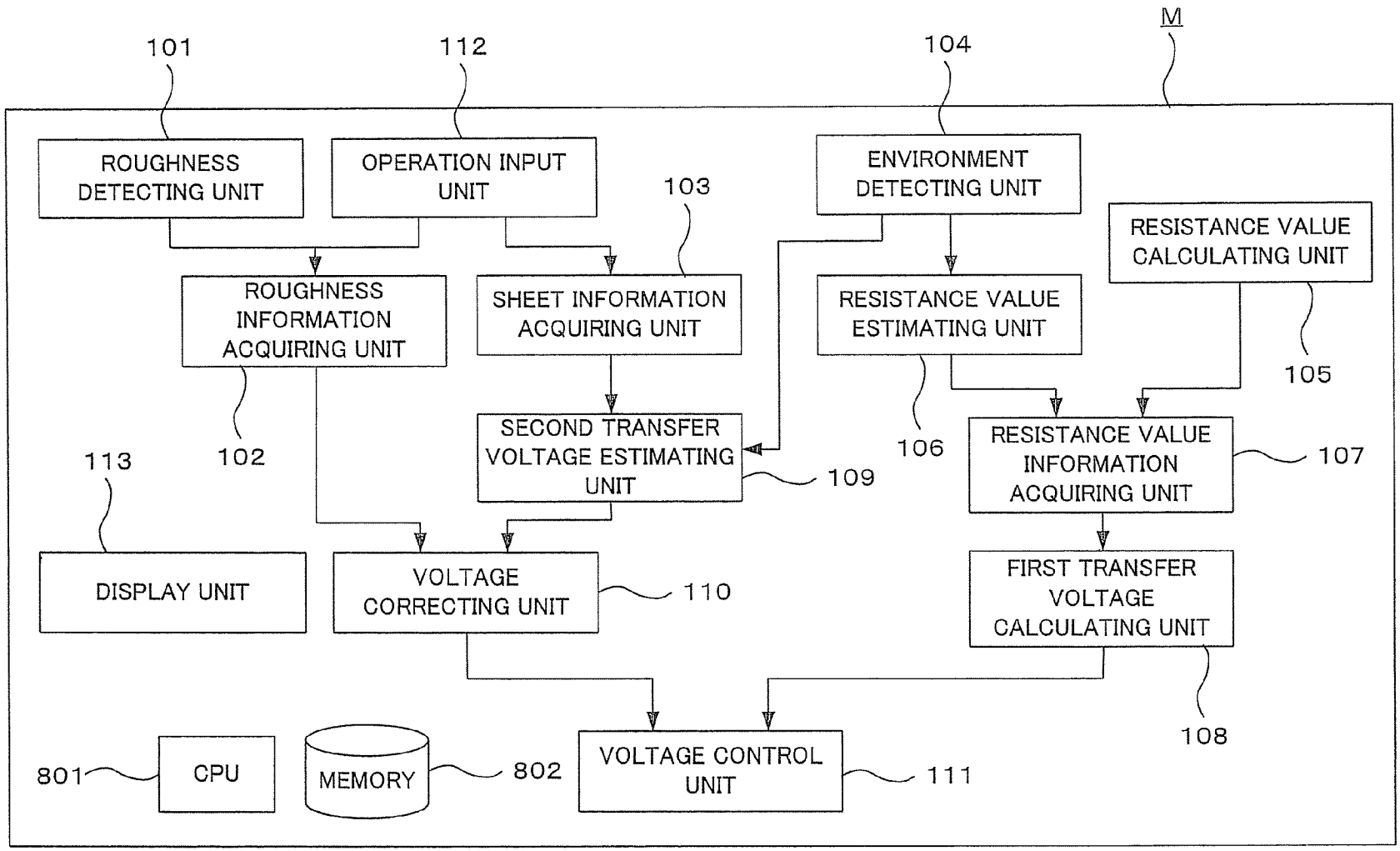
FIG. 2 is a functional block diagram for explaining the image forming apparatus according to the embodiment.

FIG. 2 is a functional block diagram for explaining the image forming apparatus M according to this embodiment. The image forming apparatus M of this embodiment includes a roughness detecting unit 101, a roughness information acquiring unit 102, a sheet information acquiring unit 103, an environment detecting unit 104, a resistance value calculating unit 105, a resistance value estimating unit 106, a resistance value information acquiring unit 107, a first transfer voltage calculating unit 108, a second transfer voltage estimating unit 109, a voltage correcting unit 110, a voltage control unit 111, an operation input unit 112, a display unit 113, a CPU 801 and a MEMORY 802.

The roughness detecting unit 101 serves to detect the surface roughness of the sheet.

The roughness information acquiring unit 102 serves to acquire, as information relating to the surface roughness of the sheet, information relating to a surface roughness value operation-inputted to the operation input unit 112 or a surface roughness value detected by the roughness detecting unit 101.

The sheet information acquiring unit 103 serves to acquire information relating to an electric resistance of the sheet. Specifically, the sheet information acquiring unit 103 acquires, as information relating to the electric resistance of the sheet, at least one of the model number, thickness, basis weight and material of the sheet based on the operation input to the operation input unit 112.

The environment detecting unit 104 serves to detect at least "humidity" as the installation environment of the image forming apparatus M.

The resistance value calculating unit 105 serves to calculate the electric resistance value of the transfer member based on a voltage value at the time when a specified current is made to flow to the transfer member.

The resistance value estimating unit 106 serves to estimate the electric resistance value of the transfer member based on the humidity detected by the environment detecting unit 104.

The resistance value information acquiring unit 107 serves to acquire the electric resistance value calculated by the resistance value calculating unit 105 or the electric resistance value estimated by the resistance value estimating unit 106 as information relating to the electric resistance of the transfer member.

The first transfer voltage calculating unit 108 serves to calculate a first transfer voltage as a voltage for the transfer member in the transfer bias voltage based on the information acquired by the resistance value information acquiring unit 107 and a specified current value.

The second transfer voltage estimating unit 109 serves to estimate a second transfer voltage as a voltage for the sheet in the transfer bias voltage based on the humidity detected by the environment detecting unit 104 and the information acquired by the sheet information acquiring unit 103.

The voltage correcting unit 110 serves to correct the voltage value of the second transfer voltage estimated by the second transfer voltage estimating unit 109 based on the information acquired by the roughness information acquiring unit 102, so that the transfer current flowing to the sheet at the time when the toner image is transferred onto the sheet becomes a specified optimum current value. Incidentally, it is preferable that the voltage correcting unit 110 makes a correction based on the information relating to the surface roughness of the sheet acquired by the roughness information acquiring unit 102, so that as the value of the surface roughness of the sheet becomes large, the post-correction value of the voltage value of the second transfer voltage estimated by the second transfer voltage estimating unit 109 becomes large.

The voltage control unit 111 serves to apply, as the transfer bias voltage, the sum of the first transfer voltage calculated by the first transfer voltage calculating unit 108 and the second transfer voltage of the voltage value corrected by the voltage correcting unit 110.

The operation input unit 112 includes a keyboard, a mouse or the like, and serves as an interface to receive the operation input of the user. Besides, the display unit 113 includes, for example, a liquid crystal display, and serves to screen-display the processing content in the image forming apparatus M. Of course, it is also possible to realize the functions of the operation input unit 112 and the display unit 113 by a touch panel display or the like.

The CPU 801 serves to perform various processings in the image forming apparatus M, and also serves to realize various functions by executing programs stored in the MEMORY 802. The MEMORY 802 includes, for example, a ROM or a RAM, and serves to store various information and programs used in the image forming apparatus M.

In general, since the first transfer voltage depending on the material of the transfer member and the surface state does not change greatly, the accuracy of the correction can be improved by correcting, as in the structure of the embodiment, only the second transfer voltage for the sheet, which is much changed in accordance with the environment.

Incidentally, in the foregoing structure, although the transfer bias voltage is divided into the "first transfer voltage" for the transfer member and the "second transfer voltage" for the sheet, for example, in the case where the voltage value of the first transfer voltage can also be estimated based on an environment factor such as humidity, the "first transfer voltage" and the "second transfer voltage" are integrated into one transfer bias voltage, and a structure as described below may be adopted.

Specifically, in an image forming apparatus for transferring a toner image onto a sheet by applying a transfer bias voltage to the sheet through a transfer member, there can be provided the image forming apparatus including a roughness information acquiring unit configured to acquire information relating to a surface roughness of the sheet, a sheet information acquiring unit configured to acquire information relating to an electric resistance of the sheet, an environment detecting unit configured to detect humidity as an installation environment of the image forming apparatus, a voltage calculating unit configured to calculate a transfer bias voltage based on the information acquired by the sheet information acquiring unit and the humidity detected by the environment detecting unit, a voltage correcting unit configured to correct a voltage value of the transfer bias voltage calculated by the voltage calculating unit based on the information acquired by the roughness information acquiring unit so that a transfer current flowing to the sheet at a time when the toner image is transferred onto the sheet becomes an optimum current value, and a voltage control unit configured to apply the transfer bias voltage of the voltage value corrected by the voltage correcting unit.

Incidentally, the humidity detected by the environment detecting unit is, for example, relative humidity. Besides, although the environment detecting unit detects at least the humidity as an environment factor which becomes a primary factor to change the electric resistance of the sheet in the thickness direction, no limitation is made to this, and for example, in the case where temperature changes the electric resistance of the sheet according to the material of the sheet, the temperature or the like may also be detected.

Figure 3:
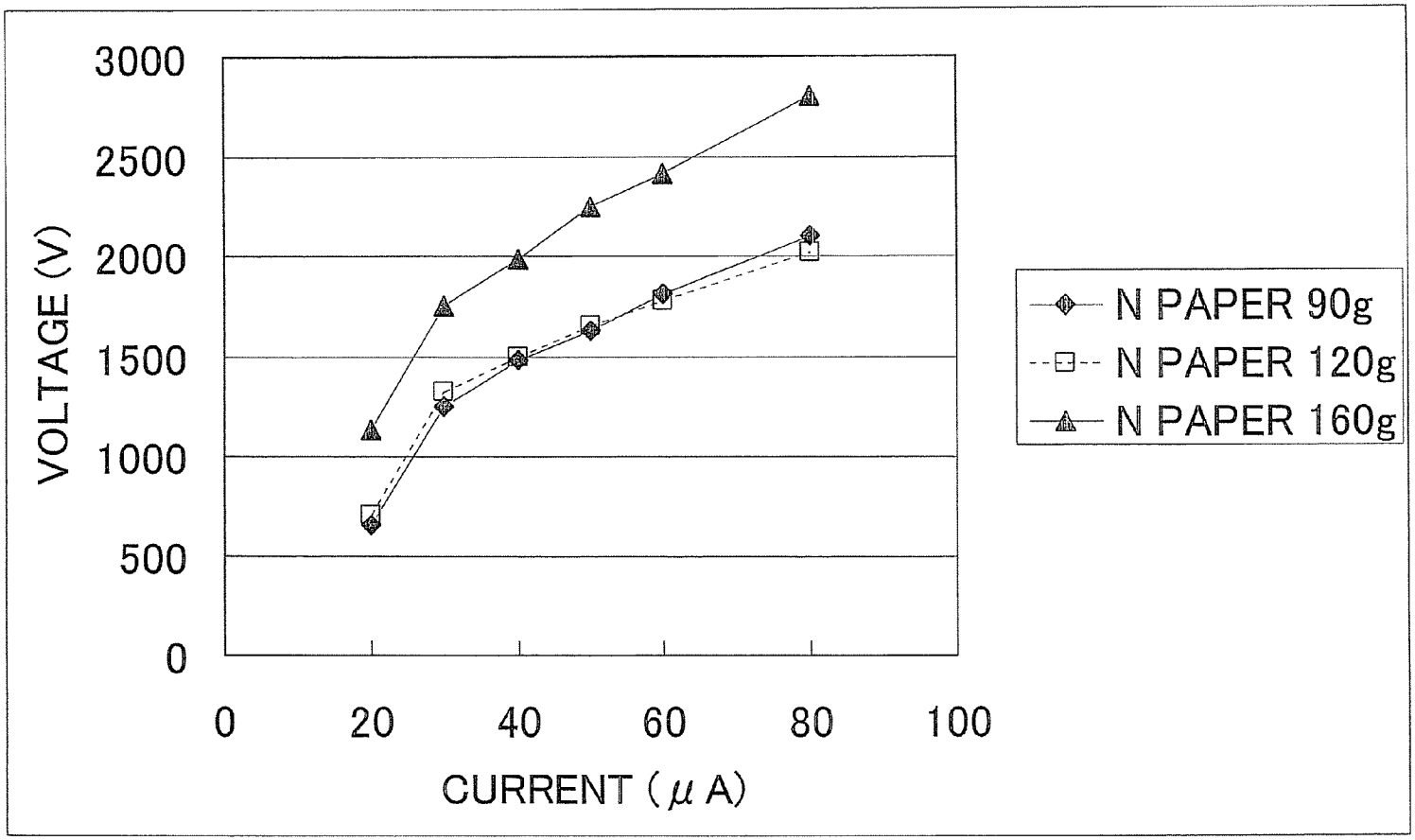
FIG. 3 is a view showing a relation between a transfer current in secondary transfer and a sheet voltage (voltage applied to a sheet in a transfer voltage) with respect to four kinds of sheets made by the same maker and different in basis weight.
Figure 4:
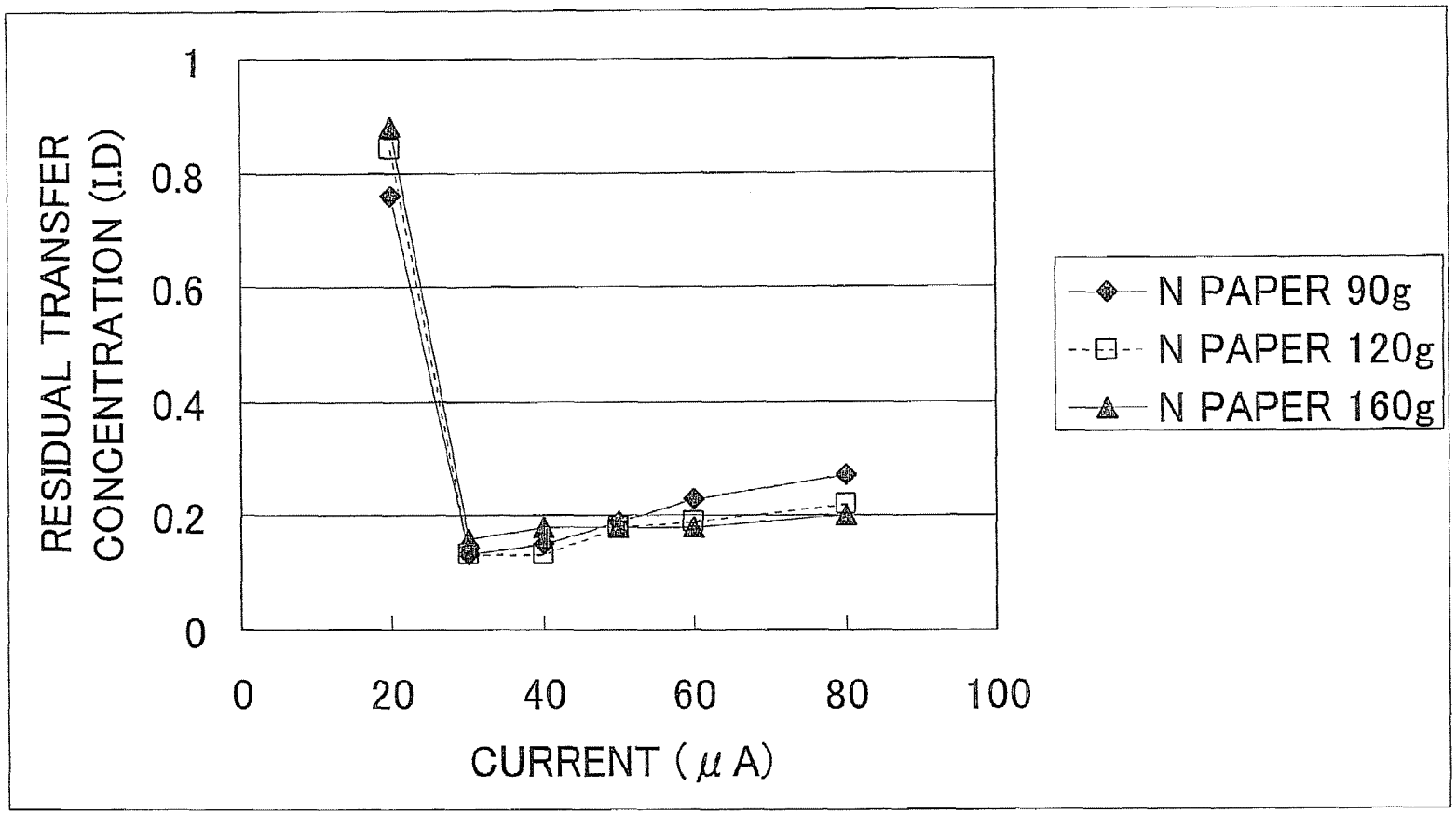
FIG. 4 is a view showing a result of evaluation of transfer performance for each sheet.

FIG. 3 shows a relation between a transfer current and a transfer voltage in secondary transfer with respect to three kinds of sheets made by the same maker and having different basis weights. Although this current voltage characteristic indicates the characteristic of the whole transfer unit including the secondary transfer member and the like, since things other than the sheet are common, the characteristic of the sheet can be indirectly compared. From this result, it is understood that materials different in electric resistance are used according to the basis weight. When the transfer performance in the case where these sheets are used is evaluated while the concentration of residual transfer toner (residual transfer concentration) is used as an index, it becomes as shown in FIG. 4. The horizontal axis indicates a transfer current and the vertical axis indicates a reflection concentration value obtained by taping the transfer residual toner on a belt after the secondary transfer and measuring it by a Macbeth densitometer. It is found from these that the optimum transfer current is about 30 to 40 μA. This indicates that even if the sheet resistance varies, when the transfer current is kept constant, the optimum transfer can be performed. However, when a relation between a transfer current and a transfer residue on the belt after secondary transfer is investigated with respect to a sheet having almost the same basis weight and made by a different maker, it becomes as shown in FIG. 5, and it has been found that although the basis weight is almost the same, the optimum transfer current is about 60 to 80 μA and is different from that of the former maker.

As a result of diligent investigation as to the cause of this difference, it has been found that this difference is caused by the surface roughness of the sheet.

Figure 5:
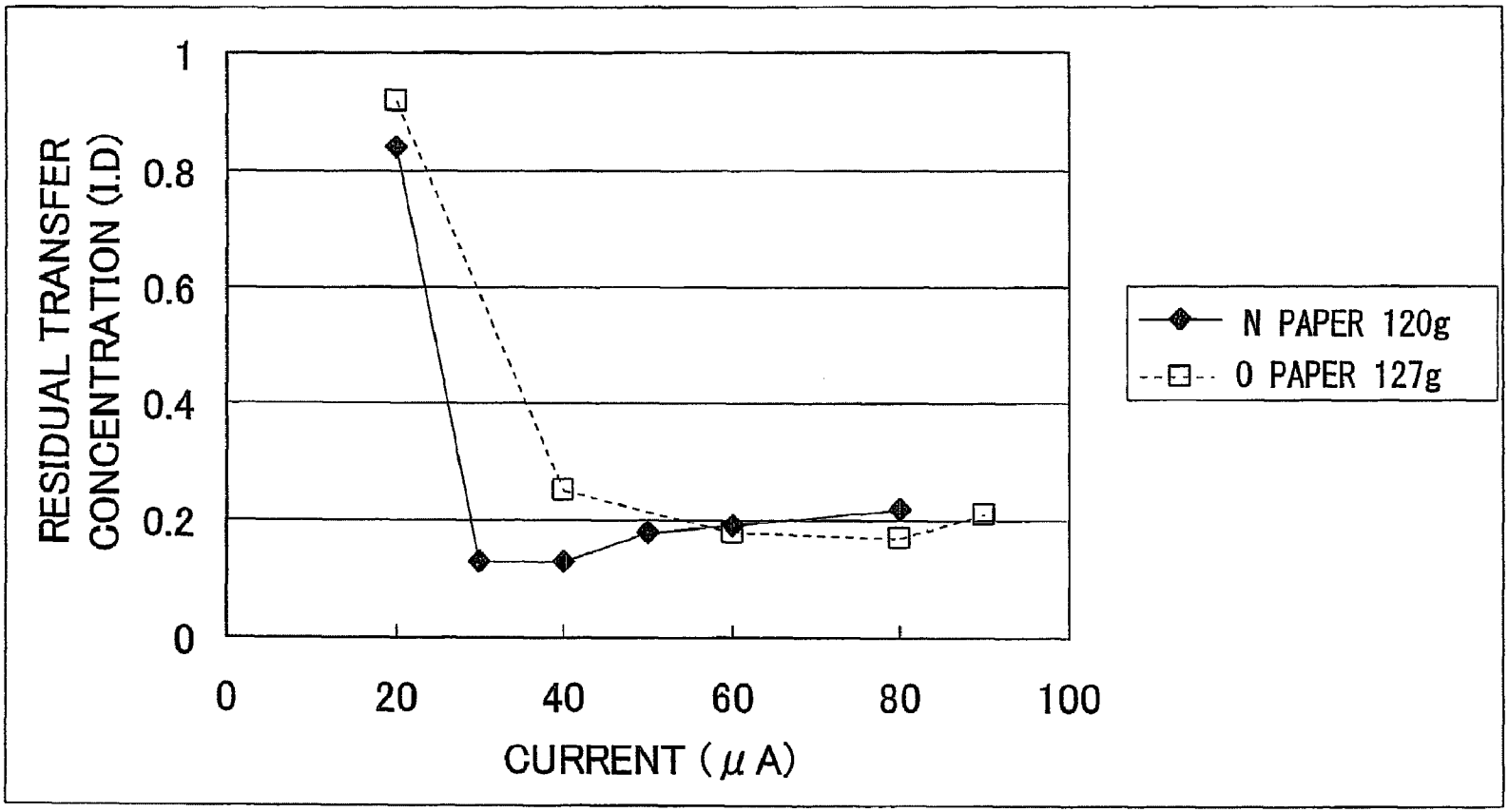
FIG. 5 is a view showing a relation between a transfer current and a transfer residue on a belt after secondary transfer.
Figure 6:
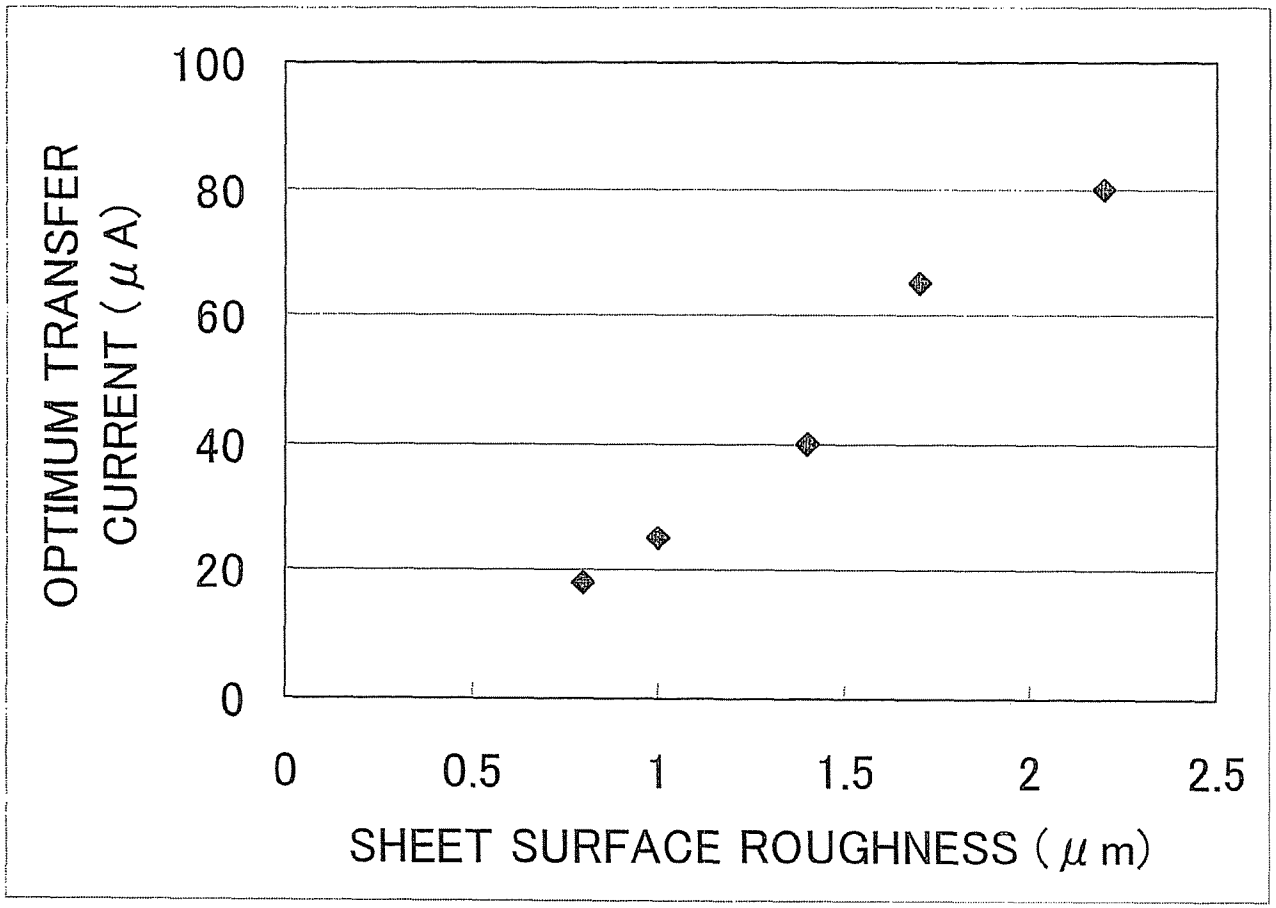
FIG. 6 is a view showing a relation between a surface electric roughness of a sheet and an optimum transfer current.

When the surface roughnesses of two kinds of sheets shown in FIG. 5 are measured, the N paper has 1.4 μm, and the O paper has 1.8 μm, and it is understood that the sheet having the higher optimum transfer current has the large sheet surface roughness. Besides, when the surface roughnesses are measured with respect to the three kinds of sheets shown in FIG. 4, they are as shown in a the graph of FIG. 4, and it has been found that they are almost the same values. Then, the relation between the surface electric roughness of the sheet and the optimum transfer current with respect to various sheets including these sheets is measured, and it has been found that these are correlated with each other as shown in FIG. 6.

Hereinafter, the flow of a transfer bias voltage control in this embodiment will be described in detail.

Figure 7:
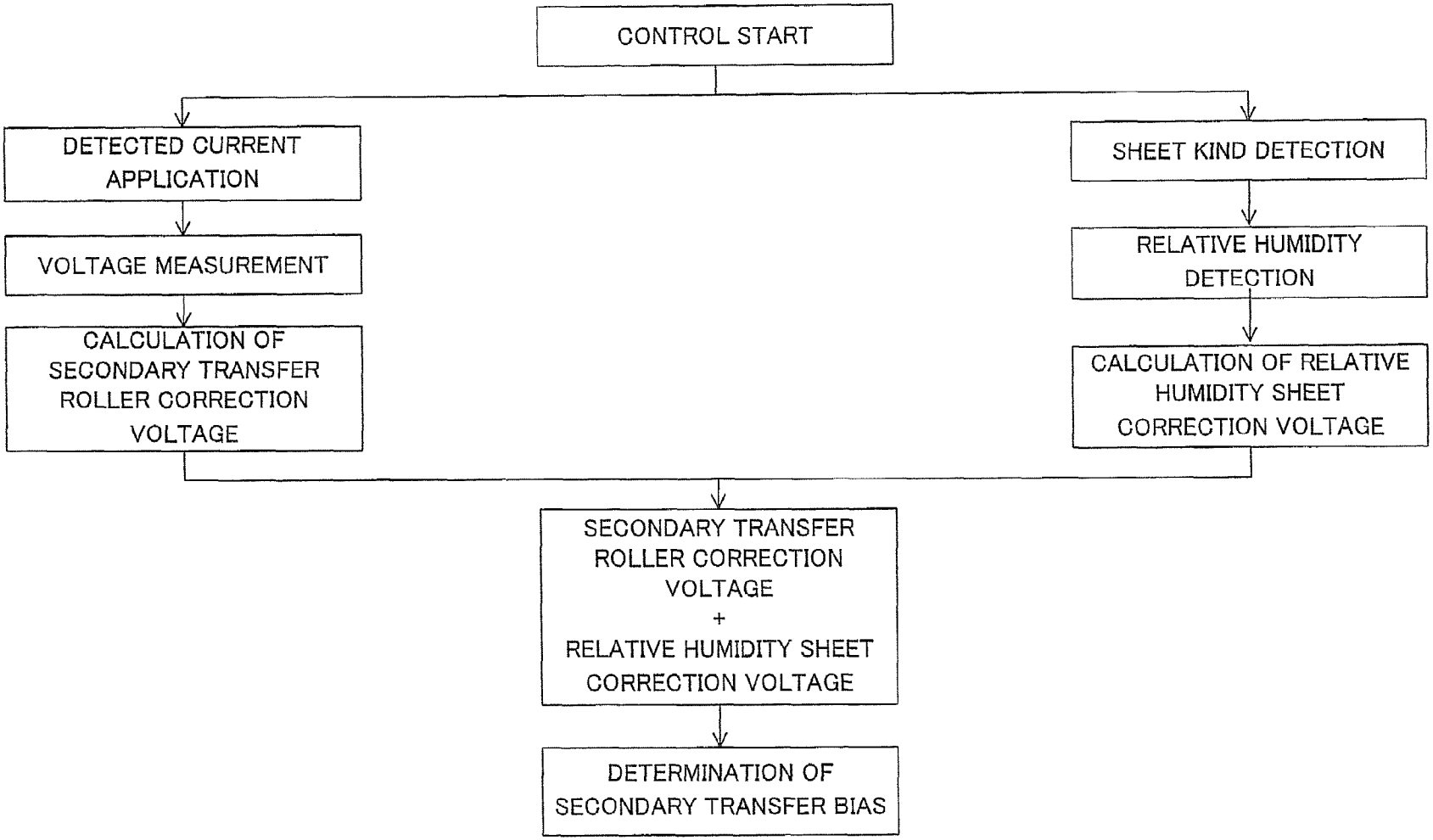
FIG. 7 is a view showing a flow of a transfer bias voltage control in this embodiment.

In the transfer bias voltage control in this embodiment, there are two flows as shown in FIG. 7. First, in one processing flow, a specified constant current (detection current) is applied to the secondary transfer unit, a voltage applied to the secondary transfer unit at that time is detected, and the electric resistance of the secondary transfer unit is detected. A secondary transfer roller correction voltage (first transfer voltage) is calculated based on this electric resistance value, so that a specified transfer current can be obtained.

In the other processing flow, a relative humidity sheet correction voltage (second transfer voltage) applied to the selected sheet is calculated from the sheet kind selected by the user and the relative humidity information detected by the environment detecting unit 104. These two correction voltages are combined to form the transfer bias voltage.

Figure 8:
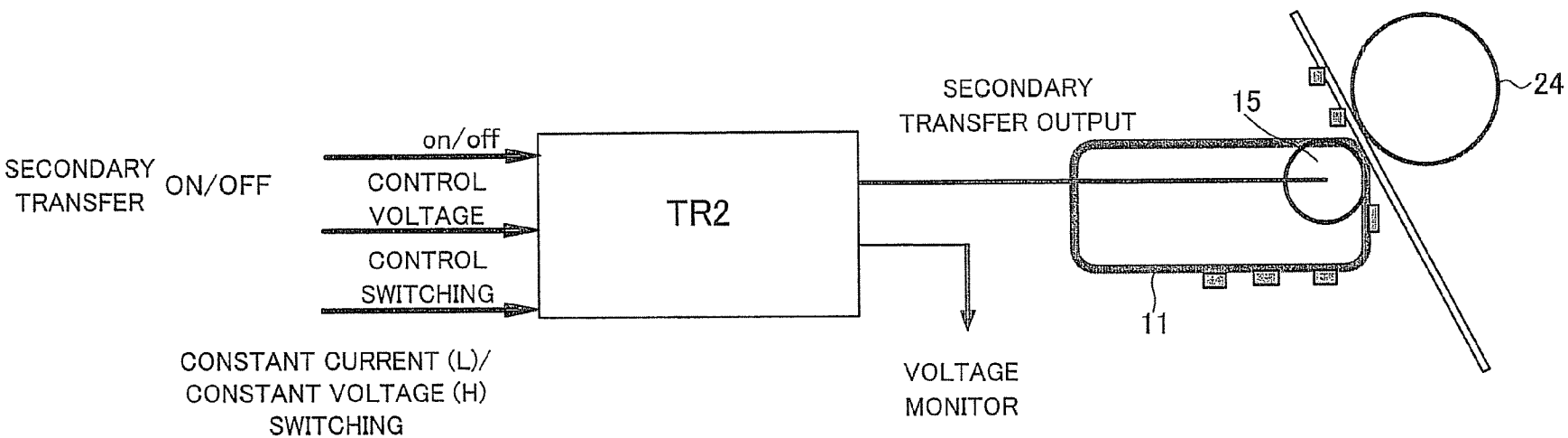
FIG. 8 is a view for explaining a control method of a secondary transfer transformer.
Figure 9:
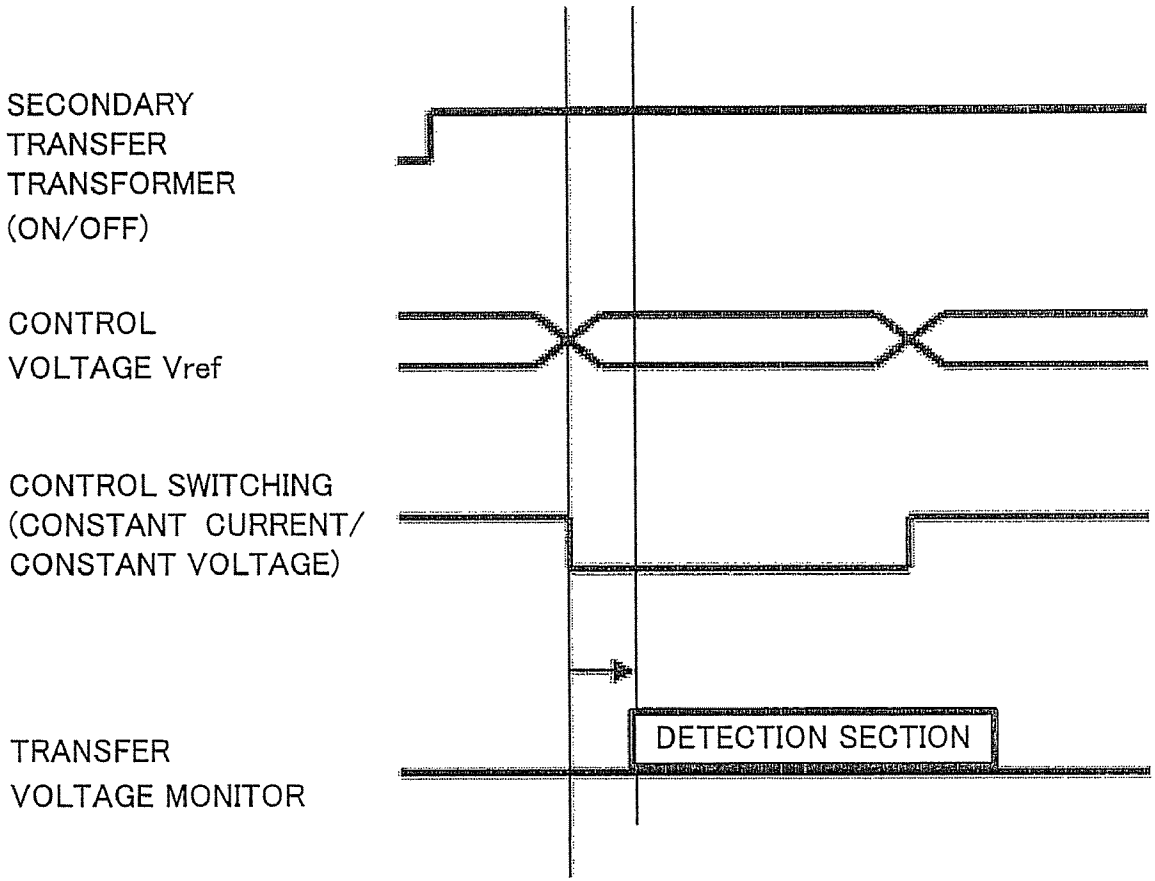
FIG. 9 is a view for explaining the control method of the secondary transfer transformer.

Next, a control method of a secondary transfer transformer TR2 will be described by use of FIG. 8 and FIG. 9. The secondary transfer transformer TR2 includes three inputs and two outputs (see FIG. 8). As the inputs, there are three input signals of an ON/OFF signal of the secondary transfer transformer, a control voltage signal to control the output level from the transformer, and a control switching signal to switch between constant current/constant voltage control. As the outputs, there are an output of a transfer bias voltage or current and a monitor voltage output of a secondary transfer voltage.

An intermediate transfer belt 11 is driven, and when it is confirmed that a secondary transfer roller 24 is in contact with the intermediate transfer belt 11, an electric resistance detecting control becomes possible, and the control is started. First, the secondary transfer transformer TR2 is turned ON, switching to the constant current output is performed by the control switching signal, and when the control voltage is set so that a specified current is obtained and is inputted to the transformer TR2, the specified constant current output is applied from the secondary transfer transformer TR2 to the secondary transfer roller 24. Further, a voltage generated at that time is outputted as a monitor voltage from the secondary transfer transformer TR2. After a specified time has passed since the secondary transfer current was applied, that is, after the applied current becomes stable, this monitor voltage is detected. Although depending on the characteristic of the transformer, the time from the application of the secondary transfer current to the detection of the voltage is about 50 msec. Besides, although the time in which the voltage is detected is suitable to be one or more rounds of the secondary transfer roller 24, the detection may be performed in one round or less according to circumstances.

For example, when the diameter of the secondary transfer roller 24 is 28 mm, the process speed is 150 mm/sec, and the sampling period is 24 msec, the number of times of sampling is about 24, and averaging is performed for this and a measurement voltage is obtained. A relation between the measurement voltage and the secondary transfer roller correction voltage is stored in the MEMORY 802 as a table of six points, and the secondary transfer roller correction voltage is calculated by linear interpolation between the respective two points. When the detection current and the transfer current are identical to each other, the measured voltage substantially becomes the secondary transfer roller correction voltage as it is. Since the detection current is fixed to 30.mu·A, in the case where the process speed varies, a desired transfer current varies, and therefore, the measurement voltage and the secondary transfer roller correction voltage are different from each other. Next, the relative humidity sheet correction voltage will be described. This corresponds to a divided voltage of the transfer voltage applied to the electric resistance of the sheet and the toner layer. Besides, with respect to relative humidities of 6 points, values of relative humidity sheet correction voltage are stored in the MEMORY 802 as a table, and the relative humidity sheet correction voltage is calculated by the linear interpolation between the respective two points. These tables are prepared for respective kinds of sheets, for example, normal paper, thick paper, thin paper, recycled paper and the like and for the respective sheets which the user can set by a control panel or a printer driver.

When the second side in two-sided printing is printed, the sheet once passes through the fixing unit 33 at the time of the print processing to the first side, so that the sheet becomes rid of moisture and the electric resistance becomes high, and therefore, even if the other condition is the same, the same table as that of the printing of the first side can not be used. Accordingly, it is preferable to prepare a back side correction voltage table for each sheet. However, with respect to a sheet, such as an OHP or special paper, which is known not to be subjected to the two-sided printing, it is not necessary to prepare the table for the second side.

When the control is started, based on the kind of the sheet specified by the user and the relative humidity value detected by the environment detecting unit 104, the relative humidity sheet correction voltage is calculated by the linear interpolation between two points from the table of the relative humidity sheet correction voltage with respect to the relative humidity. However, in the case where the value of the surface roughness of the sheet is different from a specified surface roughness value, the relative humidity sheet correction voltage is corrected according to the difference of the value. For example, in the case where the value of the surface roughness is larger than the specified value, the relative humidity sheet correction voltage is set to be larger than a normal value. On the other hand, in the case where the value of the surface roughness is smaller than the specified value, the relative humidity sheet correction voltage is set to be smaller than the normal value. The calculated secondary transfer roller correction voltage (first transfer voltage) and the relative humidity sheet correction voltage (second transfer voltage) are summed to obtain the transfer bias voltage.

Figure 10:
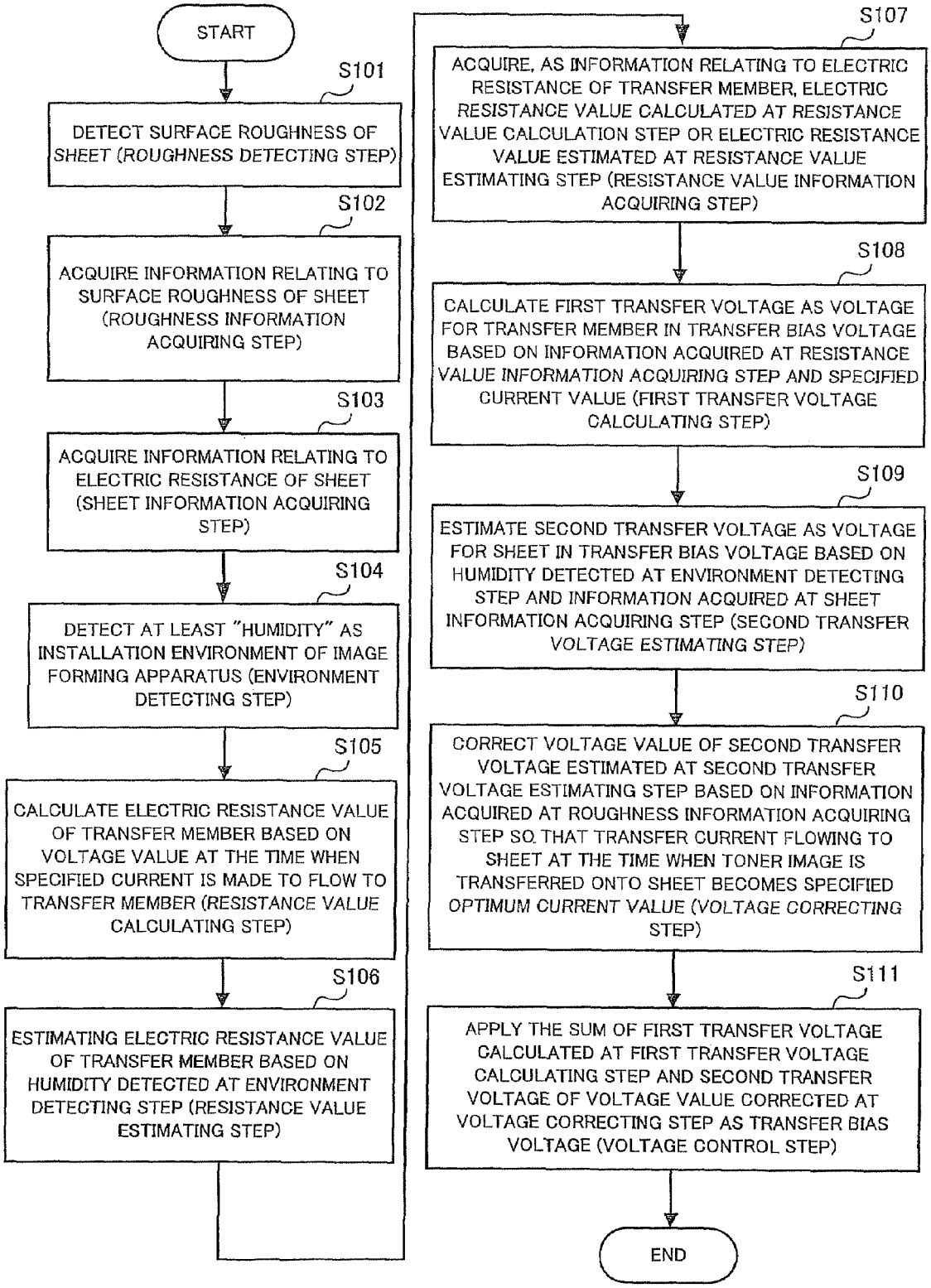
FIG. 10 is a flowchart for explaining a flow of a processing (image forming method) in the image forming apparatus according to the embodiment.

FIG. 10 is a flowchart for explaining the flow of a processing (image forming method) in the image forming apparatus M according to this embodiment.

First, the roughness detecting unit 101 detects the surface roughness of the sheet (roughness detecting step) (S101). Specifically, as the detecting method of the surface roughness of the sheet, for example, a method of two-dimensionally grasping the sheet surface, such as a method of calculating the surface roughness by using a CCD sensor to take a picture of the sheet surface and by an image processing, or a method of using a CMOS area sensor, is effective.

Figure 11:
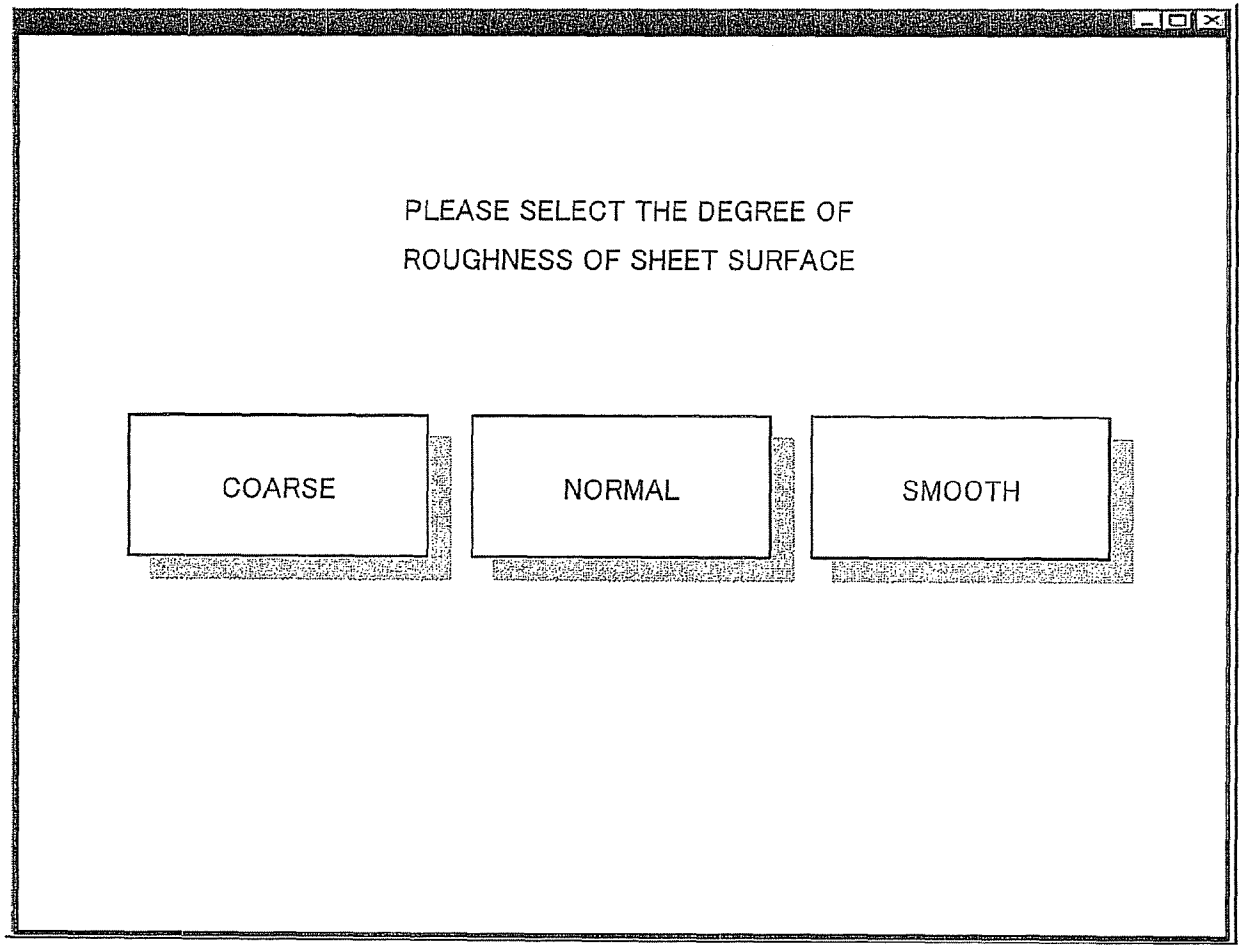
FIG. 11 is a view showing an example of an operation input screen displayed on a display unit.

The roughness information acquiring unit 102 acquires, as information relating to the surface roughness of the sheet, "information relating to the surface roughness value of the sheet" operation-inputted to the operation input unit 112 or the surface roughness value detected at the roughness detecting step (roughness information acquiring step) (S102). FIG. 11 is a view showing an example of an operation input screen displayed on the display unit 113. The user inputs information (here, three kinds of "coarse", "normal" and "smooth") relating to the surface roughness of the sheet by the operation input unit 112 in accordance with the display content of the display screen shown in the drawing. Incidentally, here, although the structure is such that the surface roughness of the sheet is defined by the user's subjectivity, more objective data can also be inputted by, for example, inputting the numerical value of the surface roughness value or inputting the model number of the sheet.

Figure 12:
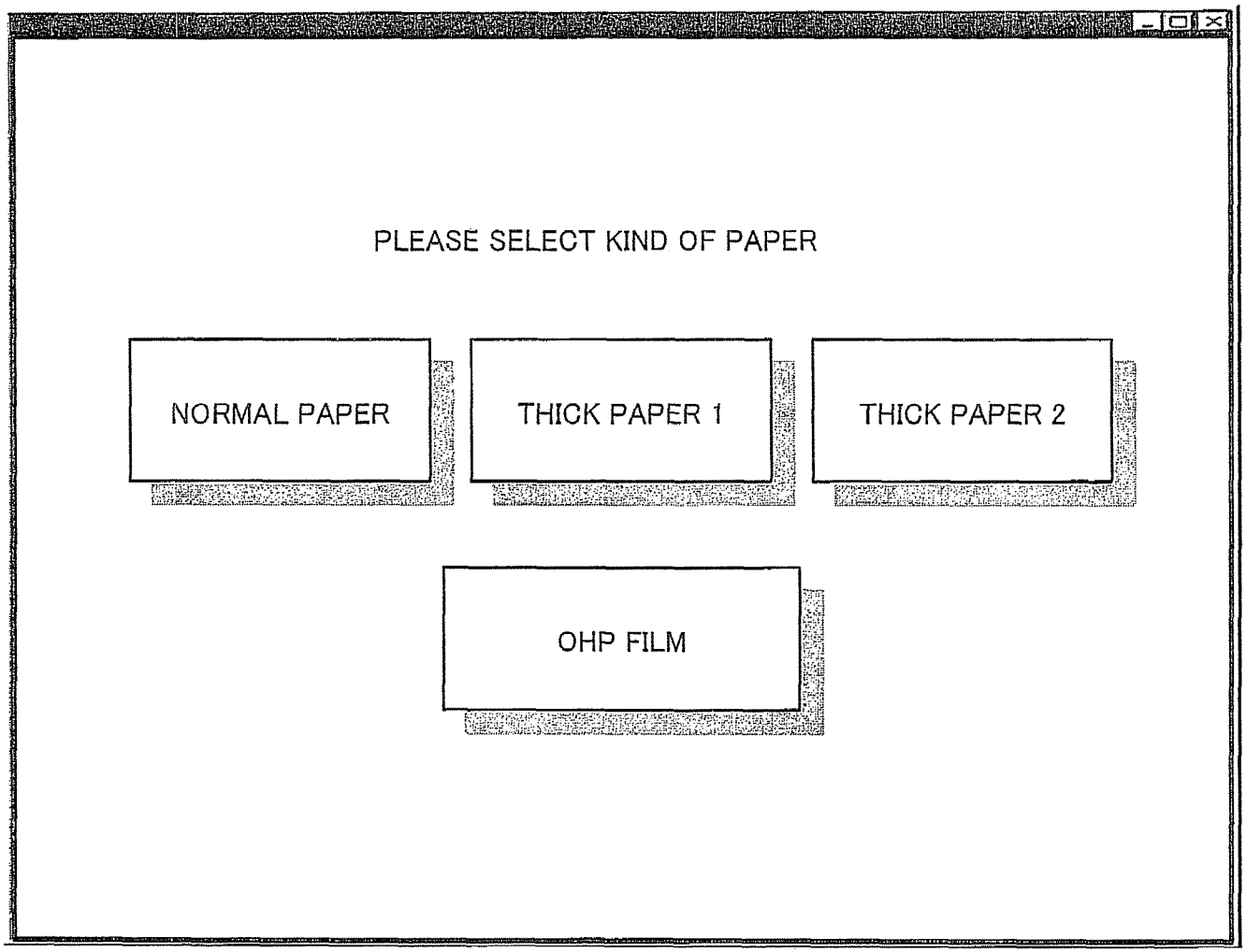
FIG. 12 is a view showing an example of the operation input screen displayed on the display unit.

The sheet information acquiring unit 103 acquires the "information relating to the electric resistance of the sheet" operation-inputted to the operation input unit 112 (sheet information acquiring step) (S103). Specifically, at the sheet information acquiring step, at least one of the model number, thickness, basis weight and material of the sheet is acquired as the information relating to the electric resistance of the sheet. FIG. 12 is a view showing an example of an operation input screen displayed on the display unit 113. The user inputs information relating to the electric resistance (factor to influence the transfer performance) of the sheet by the operation input unit 112 in accordance with the display content of the display screen shown in the drawing. Here, although the structure is such that the kind of the sheet is selected, in addition to this, the model number of the sheet or the electric resistance value may be directly inputted.

Incidentally, in this embodiment, although the structure is such that the acquisition of the information in the roughness information acquiring unit 102 and the sheet information acquiring unit 103 is executed each time the secondary transfer processing to the sheet is performed, no limitation is made to this, and in the case where the kind of the sheet to be used is the same as one used in the past, the information relating to the sheet is held in the MEMORY 802, and the information may be used.

The environment detecting unit 104 includes a humidity sensor or the like, and detects at least the "humidity" as the installation environment of the image forming apparatus (environment detecting step) (S104).

Figure 13:
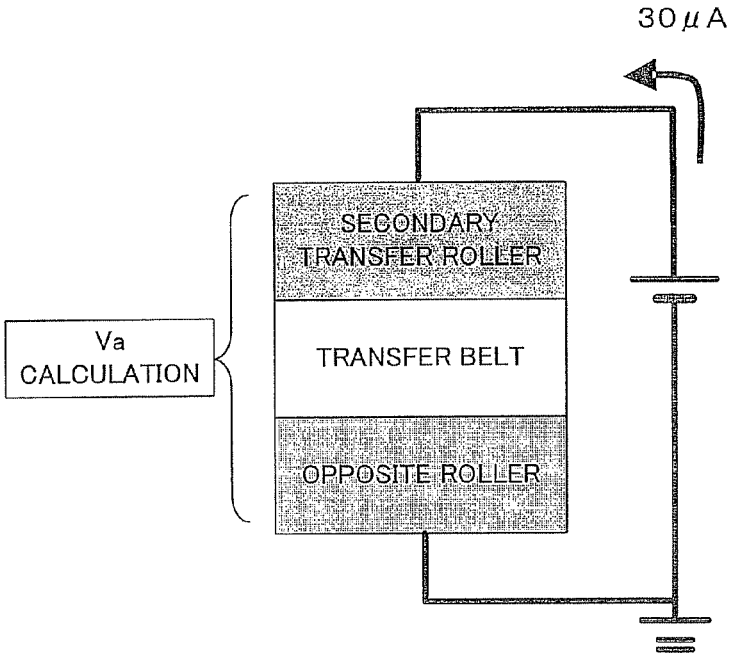
FIG. 13 is a view for explaining calculation of an electric resistance value of a transfer member by a resistance value calculating unit.

As shown in FIG. 13, the resistance value calculation unit 105 calculates the electric resistance value of the transfer member based on the voltage value at the time when a specified current is made to flow to the transfer member (resistance value calculation step) (S105).

The resistance value estimating unit 106 estimates the electric resistance value of the transfer member based on the humidity detected at the environment detecting step (resistance value estimating step) (S106).

The resistance value information acquiring unit 107 acquires the electric resistance value calculated at the resistance value calculating step or the electric resistance value estimated at the resistance value estimating step as the information relating to the electric resistance of the transfer member (resistance value information acquiring step) (S107).

The first transfer voltage calculating unit 108 calculates the first transfer voltage as the voltage for the transfer member in the transfer bias voltage based on the information acquired at the resistance value information acquiring step and a specified current value (first transfer voltage calculating step) (S108).

Figure 14:
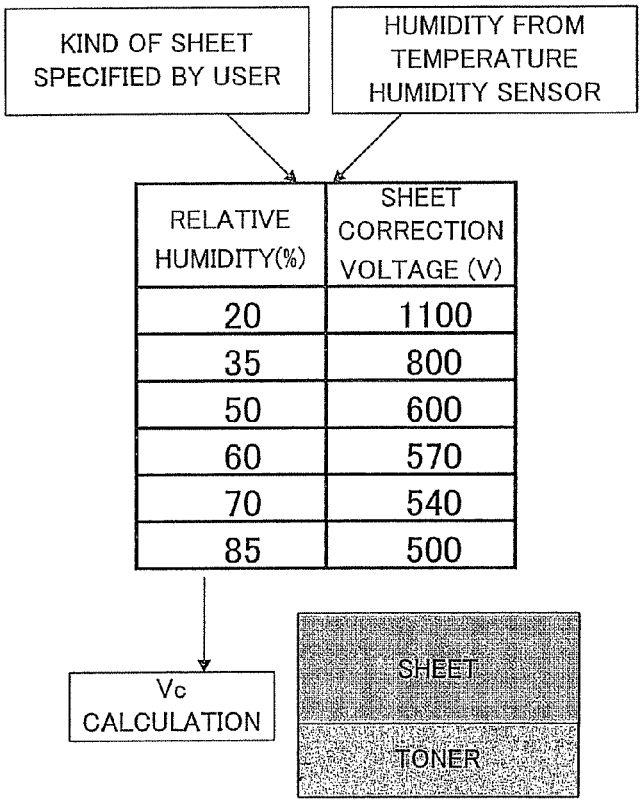
FIG. 14 is a view for explaining the estimation of a second transfer voltage by a second transfer voltage estimating unit.

The second transfer voltage estimating unit 109 estimates the second transfer voltage as the voltage for the sheet in the transfer bias voltage based on the humidity detected at the environment detecting step and the information acquired at the sheet information acquiring step (second transfer voltage estimating step) (S109) (see FIG. 14).

The voltage correcting unit 110 corrects the voltage value of the second transfer voltage estimated at the second transfer voltage estimating step based on the information acquired at the roughness information acquiring step, so that the transfer current flowing to the sheet at the time when the toner image is transferred onto the sheet becomes a specified optimum current value (voltage correcting step) (S110). Incidentally, at the voltage correcting step, it is preferable that based on the information relating to the surface roughness of the sheet acquired at the roughness information acquiring step, the correction is performed so that as the value of the surface roughness of the sheet becomes large, the post-correction value of the voltage value of the second transfer voltage estimated at the second transfer voltage estimating step becomes large.

The voltage control unit 111 applies, as the transfer bias voltage, the sum of the first transfer voltage calculated at the first transfer voltage calculating step and the second transfer voltage of the voltage value corrected at the voltage correcting step (voltage control step) (S111). As stated above, in this embodiment, the secondary transfer roller correction voltage (first transfer voltage) Va and the relative humidity sheet correction voltage (second transfer voltage) Vc are calculated, and both are added to obtain the transfer bias voltage.

As described above, according to this embodiment, in an image forming method for transferring a toner image onto a sheet by applying a transfer bias voltage to the sheet through a transfer member, there can also be provided the image forming method including a roughness information acquiring step of acquiring information relating to a surface roughness of the sheet, a sheet information acquiring step of acquiring information relating to an electric resistance of the sheet, an environment detecting step of detecting a humidity as an installation environment of the image forming apparatus, a voltage calculating step of calculating a transfer bias voltage based on the information acquired at the sheet information acquiring step and the humidity detected at the environment detecting step, a voltage correcting step of correcting a voltage value of the transfer bias voltage calculated at the voltage calculating step based on the information acquired at the roughness information acquiring step so that a transfer current flowing to the sheet at a time when the toner image is transferred onto the sheet becomes an optimum current value, and a voltage control step of applying the transfer bias voltage of the voltage value corrected at the voltage correcting step. Besides, in the image forming method of the structure as stated above, at the voltage correcting step, it is desirable that the correction is performed based on the information relating to the surface roughness of the sheet acquired at the roughness information acquiring step, so that as the value of the surface roughness of the sheet becomes large, the post-correction value of the voltage value of the transfer bias voltage calculated at the voltage calculating step becomes large. Besides, in the image forming method of the structure as stated above, there is provided an operation input step of receiving an operation input of a user, and at the roughness information acquiring step, the information relating to the surface roughness of the sheet may be acquired based on the operation input at the operation input step. Besides, in the image forming method of the structure as stated above, there is provided a roughness detecting step of detecting the surface roughness of the sheet, and at the roughness information acquiring step, a value of the surface roughness detected at the roughness detecting step can also be acquired. Besides, in the image forming method of the structure as stated above, at the sheet information acquiring step, it is preferable that at least one of the model number, thickness, basis weight and material of the sheet is acquired as the information relating to the electric resistance of the sheet.

Second Embodiment

Next, a second embodiment of the invention will be described. This embodiment is a modified example of the first embodiment, and the structure of a secondary transfer unit in an image forming apparatus of this embodiment is similar to that of the first embodiment as shown in FIG. 15.

Figure 15:
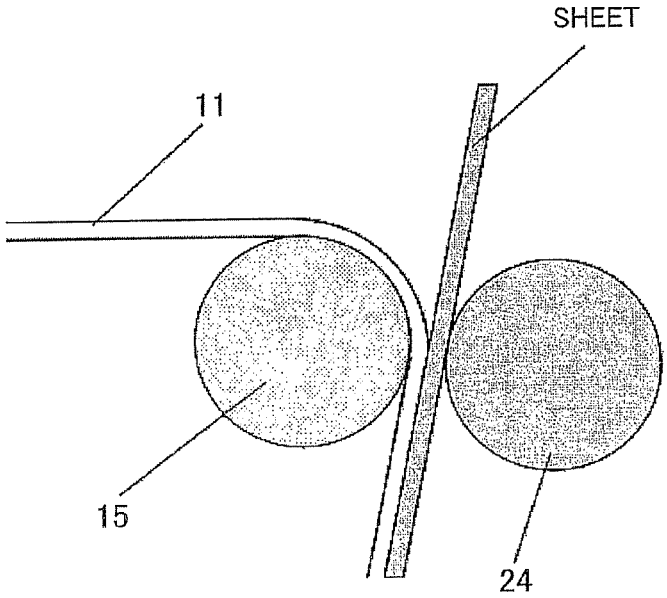
FIG. 15 is a view showing a structure of a secondary transfer unit in an image forming apparatus according to a second embodiment of the invention.
Figure 16:
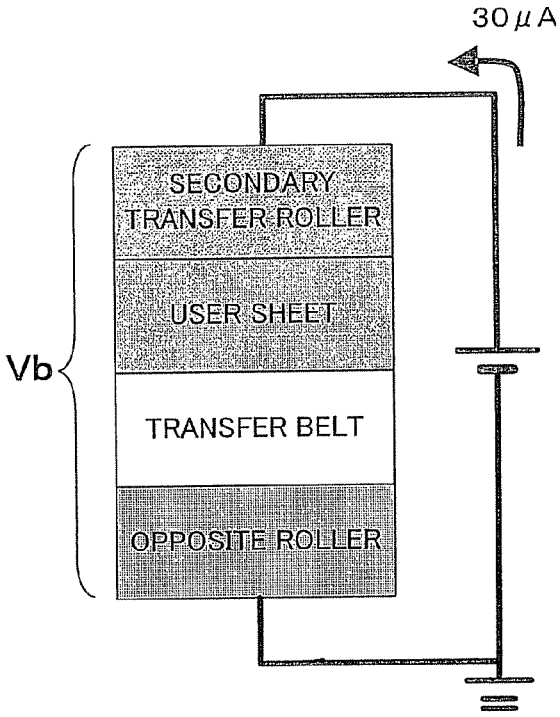
FIG. 16 is a view for explaining electric resistance detection of the secondary transfer unit in a state where a sheet is nipped in the secondary transfer unit.

In this embodiment, a relative humidity sheet correction voltage table is not used, and as shown in FIG. 15 and FIG. 16, in a state where the sheet is nipped in the secondary transfer unit, the electric resistance detection of the secondary transfer unit is performed, the obtained voltage is made Vb, a correction voltage of the sheet is directly acquired from Vb−Va, and a specified voltage for toner is added to obtain a sheet correction voltage Vc. Here, similarly to the foregoing embodiment, in the case where the value of the surface roughness of the sheet is different from a specified value, the sheet correction voltage is corrected according to the difference.

For example, in the case where the value of the surface roughness is larger than the specified value, the sheet correction voltage is set to be larger than a normal value. On the other hand, in the case where the value of the surface roughness is smaller than the specified value, the sheet correction voltage is set to be smaller than the normal value. The calculated secondary transfer roller correction voltage and the relative humidity sheet correction voltage are added to obtain a transfer bias voltage.

Figure 17:
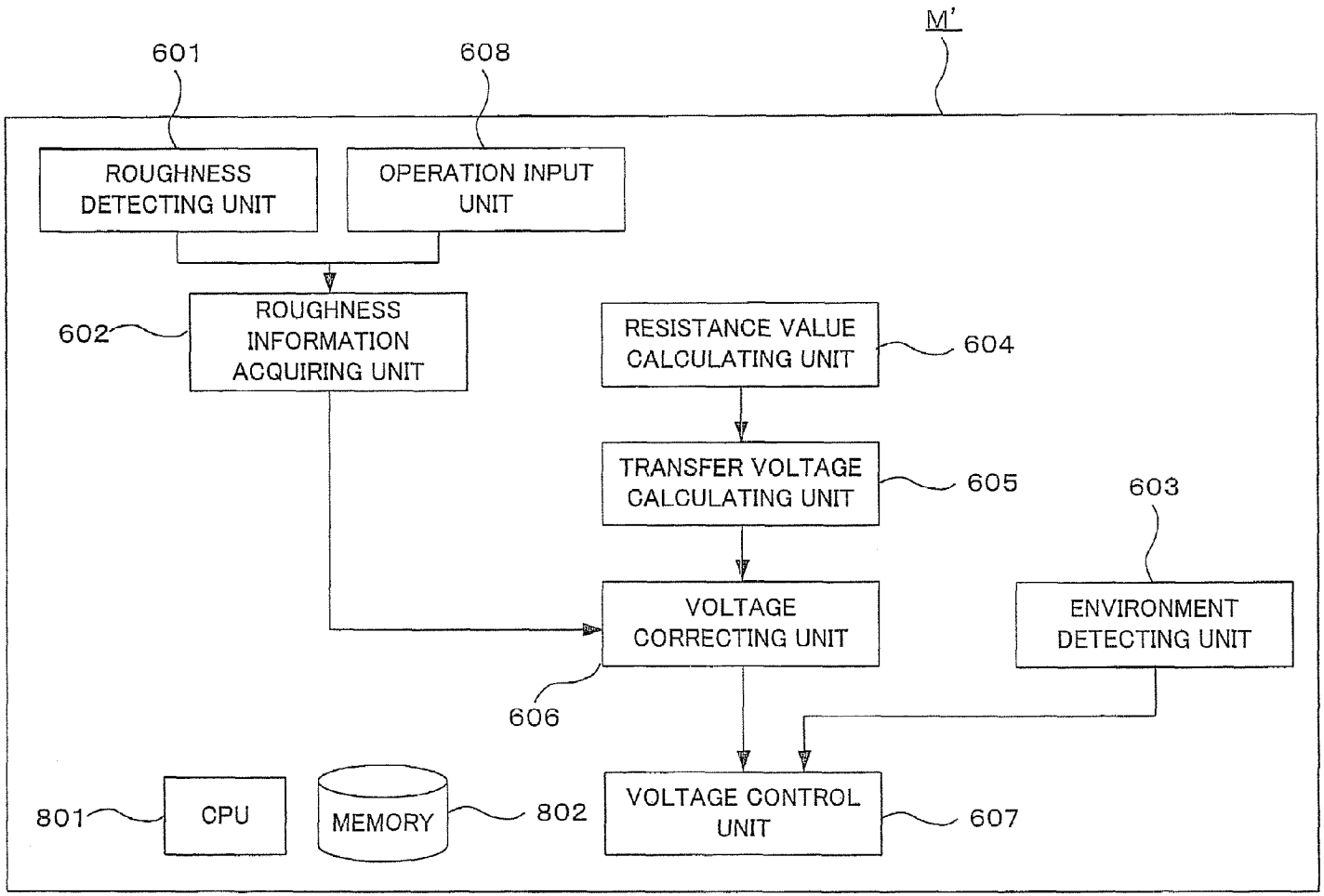
FIG. 17 is a functional block diagram for explaining a structure of the image forming apparatus according to the second embodiment of the invention.

FIG. 17 is a functional block diagram for explaining the structure of an image forming apparatus M' according to the second embodiment of the invention. Specifically, the image forming apparatus M' of this embodiment includes a roughness detecting unit 601, a roughness information acquiring unit 602, an environment detecting unit 603, a resistance value calculating unit 604, a transfer voltage calculating unit 605, a voltage correcting unit 606, a voltage control unit 607, an operation input unit 608, a CPU 801 and a MEMORY 802.

The operation input unit 608 serves to receive an operation input of a user.

The roughness detecting unit 601 serves to detect a surface roughness of a sheet.

The roughness information acquiring unit 602 serves to acquire information relating to the surface roughness of the sheet based on a value of the surface roughness detected by the roughness detecting unit 601 or the operation input to the operation input unit 608.

The environment detecting unit 603 serves to detect temperature and humidity as an installation environment of the image forming apparatus M'.

The resistance value calculating unit 604 serves to calculate electric resistance values of the transfer member and the sheet at a timing when the sheet is nipped in the secondary transfer unit and based on a voltage value at a time when a specified current is made to flow to the sheet through the transfer member.

The transfer voltage calculating unit 605 serves to calculate a transfer bias voltage in the secondary transfer unit based on the electric resistance value calculated by the resistance value calculating unit 604 and the specified current value.

The voltage correcting unit 606 serves to correct the voltage value of the transfer bias voltage calculated by the transfer voltage calculating unit 605 based on the information acquired by the roughness information acquiring unit 602 so that a transfer current flowing to the sheet at the time when the toner image is transferred onto the sheet becomes a specified optimum current value.

The voltage correcting unit 606 performs a correction based on the information relating to the surface roughness of the sheet acquired by the roughness information acquiring unit 602, so that as the value of the surface roughness of the sheet becomes large, a post-correction value of the voltage value of the transfer bias voltage calculated by the transfer voltage calculating unit 605 becomes large.

In the case where the temperature and humidity detected by the environment detecting unit 603 is a specified high temperature and high humidity environment, the voltage control unit 607 applies, as the transfer bias voltage, the sum of a specified correction voltage value according to the temperature and humidity and the voltage value corrected by the voltage correcting unit 606.

Third Embodiment

Next, an image forming apparatus according to a third embodiment of the invention will be described.

In this embodiment, by using the surface roughness of the sheet, the transfer bias voltage can be determined more precisely than the foregoing embodiment.

Figure 18:
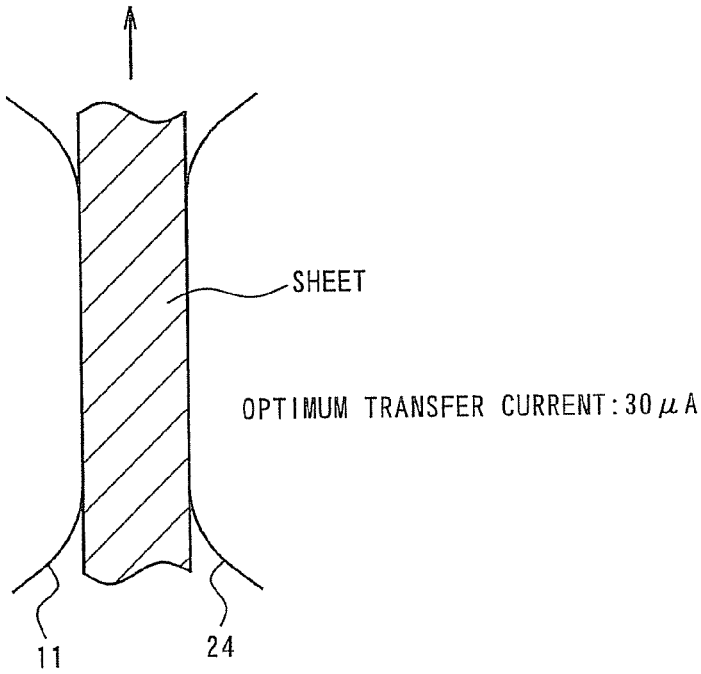
FIG. 18 is a view for explaining a relation between a surface roughness of a sheet and an optimum transfer current.
Figure 19:
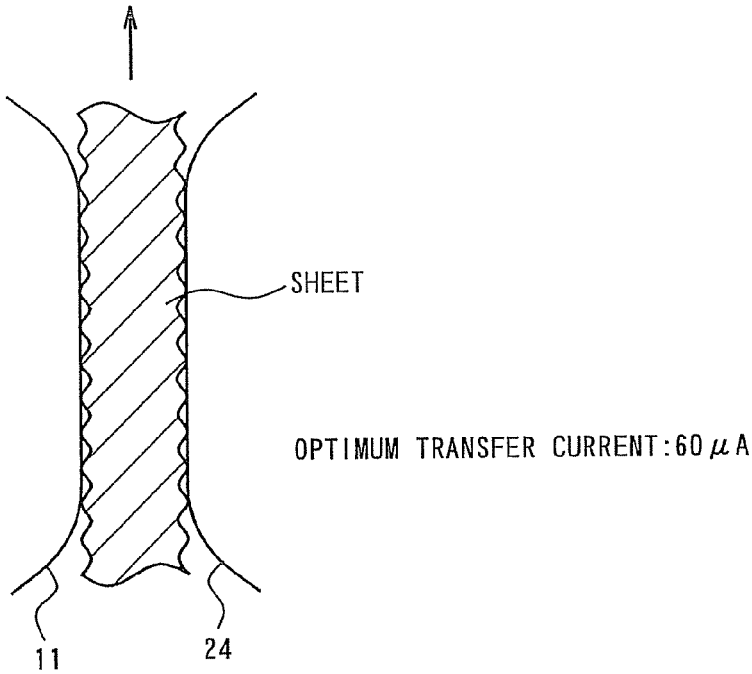
FIG. 19 is a view for explaining a relation between a surface roughness of a sheet and an optimum transfer current.

First, the surface roughness of the sheet is detected by the roughness detecting unit. It is preferable that the detection of the surface roughness of the sheet is performed in the vicinity of a position where the sheet is nipped by register rollers. The detection of the surface roughness is performed such that the sheet surface is two-dimensionally grasped as a grayscale picture by a CMOS sensor, and is converted into roughness information by an image processing. The optimum transfer current is determined by referring to a previously defined relation between a sheet surface roughness and a suitable transfer current. For example, in an "A" sheet with a surface roughness of about 1.4 μm, the suitable transfer current becomes 40 μA (see FIG. 18). Besides, in a "B" sheet with a surface roughness of about 1.8 μm, the suitable transfer current becomes 60 μA (see FIG. 19).

Next, in order to calculate a secondary transfer roller correction voltage, similarly to the first embodiment, a constant current of 30 μA is applied in a state where the sheet is not nipped in the secondary transfer unit, and a voltage Va applied to the secondary transfer unit is measured. Here, since a suitable transfer current and a resistance detection current are different between the case of the "A" sheet and the case of the "B" sheet, the voltage measured at 30 μA is converted into that of the case of 40 μA and 60 μA by using a conversion table. In this case, a converted secondary transfer roller correction voltage Va' is 1000V in the case of the "A" sheet, and 1400V in the case of the "B" sheet.

Next, in order to calculate the sheet correction voltage, similarly to the second embodiment, a constant current of 30 μA is applied in the state where the sheet is nipped in the secondary transfer unit, and a voltage Vb applied to the secondary transfer unit is measured. Here, although Vb−Va is a voltage applied to the sheet, that is, the sheet correction voltage Vc, also in this case, since the suitable transfer current and the resistance detection current are different, the voltage Vc measured at 30 μA is converted into that of the case of 40 μA and 60 μA by using a conversion table. In this case, the converted sheet correction voltage Vc' is 600 V in the case of the "A" sheet, and 900 V in the case of the "B" sheet. Finally, the secondary transfer roller correction voltage Va' and the sheet correction voltage Vc' are added to obtain the secondary transfer bias. In the case of this embodiment, the secondary transfer biases of the "A" sheet and the "B" sheet become 1600 V and 2300 V, respectively. In most cases, since the resistance of the sheet is higher than the resistance of the toner, the secondary transfer bias may be Va'+Vc', however, under a high temperature and high humidity environment, since the resistance of the sheet becomes low, about 50 V to 100 V may be added as a voltage Vt for the resistance of the toner. In this case, the secondary transfer bias becomes Va'+Vc'+Vt.

As stated above, in this embodiment, the specified constant current is applied to the transfer member or the opposite member at the time when the sheet is not nipped at the secondary transfer position, the voltage applied to the secondary transfer unit at that time is detected, and the transfer member correction voltage is calculated based on the voltage, and further, the transfer material correction voltage is calculated by detecting the electric resistance of the transfer material and the surface roughness, and the transfer bias voltage is determined by adding the transfer member correction voltage, the transfer material correction voltage, and the specified toner correction voltage.

Fourth Embodiment

Next, a fourth embodiment of the invention will be described. In the foregoing respective embodiments, the transfer bias voltage is obtained based on the kind of the sheet, the humidity, the resistance value of the transfer member and the like, and the whole or part of the transfer bias voltage is corrected based on the surface roughness of the sheet, whereas in this embodiment, the surface roughness of the sheet is detected to determine an optimum transfer current, and further, the electric resistance of the sheet is detected, and an optimum transfer bias voltage is calculated from the optimum transfer current and the electric resistance of the sheet to control the secondary transfer bias.

Figure 20:
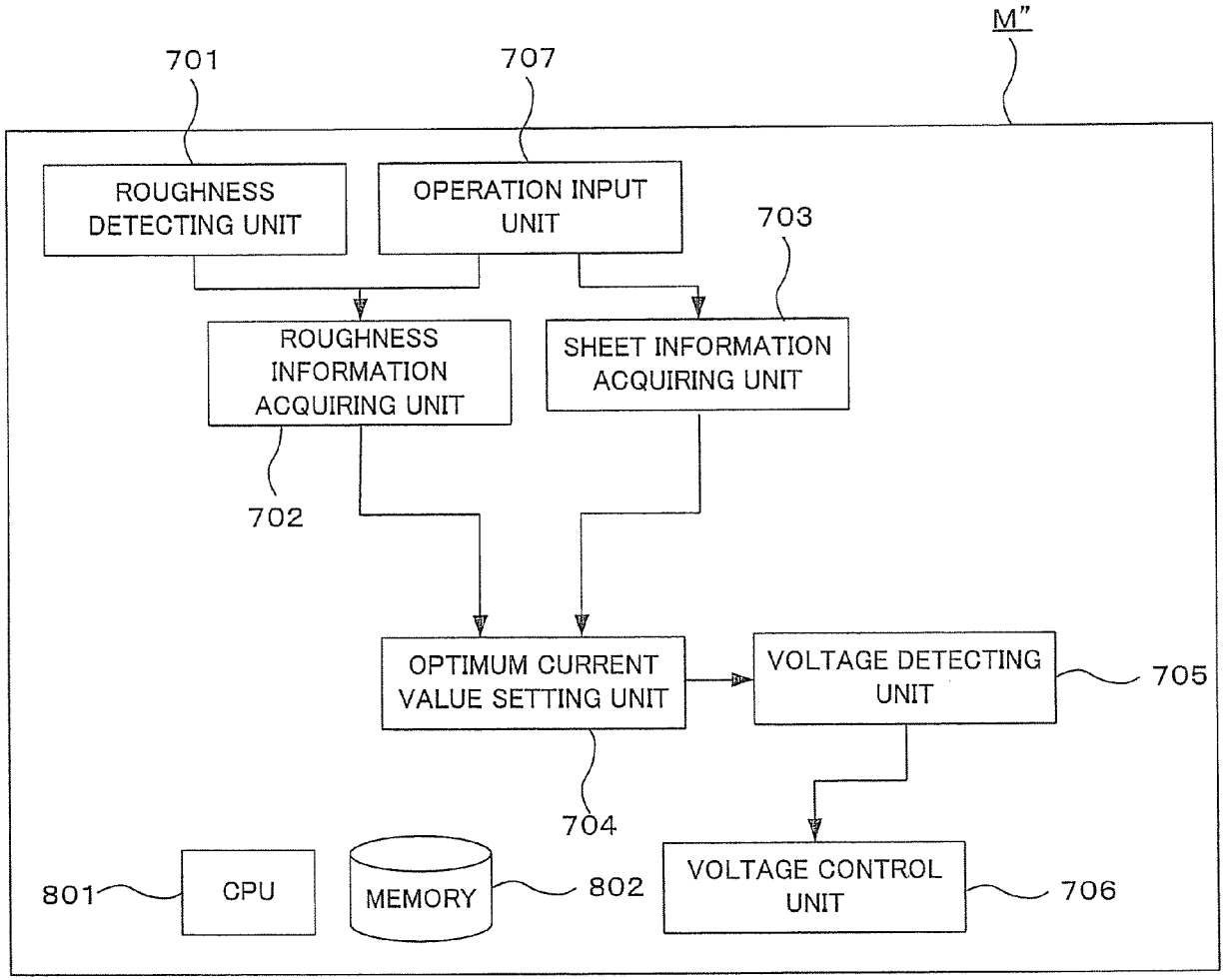
FIG. 20 is a functional block diagram for explaining an image forming apparatus according to a fourth embodiment of the invention.

FIG. 20 is a functional block diagram for explaining an image forming apparatus M" according to this embodiment. Specifically, the image forming apparatus M" according to this embodiment includes a roughness detecting unit 701, a roughness information acquiring unit 702, a sheet information acquiring unit 703, an optimum current value setting unit 704, a voltage detecting unit 705, a voltage control unit 706, an operation input unit 707, a CPU 801 and a MEMORY 802.

The roughness detecting unit 701 serves to detect a surface roughness of a sheet.

The roughness information acquiring unit 702 serves to acquire information relating to the surface roughness of the sheet based on a value of the surface roughness detected by the roughness detecting unit 701 or an operation input to the operation input unit 707.

The sheet information acquiring unit 703 serves to acquire information relating to an electric resistance of the sheet based on the operation input to the operation input unit 707.

The optimum current value setting unit 704 serves to set an optimum value of a transfer current at the time when a toner image is transferred onto the sheet based on the information acquired by the roughness information acquiring unit 702 and the sheet information acquiring unit 703. Specifically, for example, table data in which the surface roughness of the sheet, the kind of the sheet and the like are made to correspond to the optimum transfer current value is stored in the MEMORY 802, and the optimum current value setting unit 704 refers to the table data and determines the optimum value of the transfer current.

The voltage detecting unit 705 serves to detect (measure) a voltage value at the time when the transfer current of the current value set by the optimum current value setting unit 704 is made to flow to the sheet through the transfer member.

The voltage control unit 706 serves to apply (voltage constant control) the transfer bias voltage of the voltage value detected by the voltage detecting unit 705.

Figure 21:
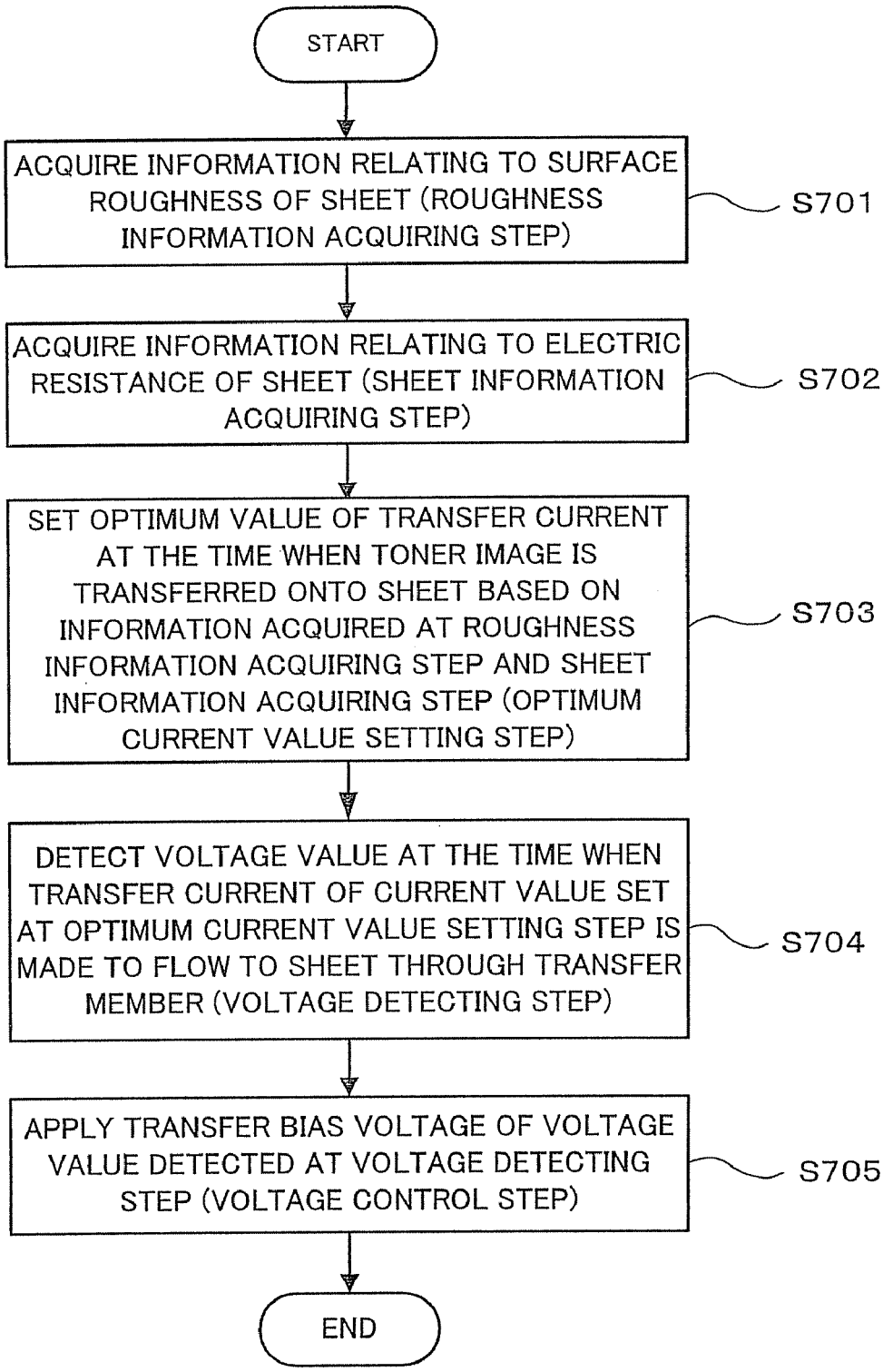
FIG. 21 is a flowchart for explaining a flow of a processing (image forming method) in the image forming apparatus according to the fourth embodiment of the invention.

FIG. 21 is a flowchart for explaining the flow of a processing (image forming method) in the image forming apparatus M" according to the fourth embodiment of the invention.

The roughness information acquiring unit 702 acquires the information relating to the surface roughness of the sheet (roughness information acquiring step) (S701).

The sheet information acquiring unit 703 acquires the information relating to the electric resistance of the sheet (sheet information acquiring step) (S702).

The optimum current value setting unit 704 sets the optimum value of the transfer current at the time when the toner image is transferred onto the sheet based on the information acquired at the roughness information acquiring step and the sheet information acquiring step (optimum current value setting step) (S703).

The voltage detecting unit 705 detects a voltage value at the time when the transfer current of the current value set at the optimum current value setting step is made to flow to the sheet through the transfer member (voltage detecting step) (S704).

The voltage control unit 706 applies the transfer bias voltage of the voltage value detected at the voltage detecting step (voltage control step) (S705).

The respective steps of the processing of the image forming apparatus in the foregoing respective embodiments are realized by causing the CPU 801 to execute an image forming program stored in the MEMORY 802.

In the foregoing respective embodiments, although the example has been mentioned in which the sheet as the object of the image forming processing is the copy paper or thick paper, no limitation is made to these, and for example, it is needless to say that an OHP film and the like may be used.

In the embodiment, although the description has been given to the case where the function to carry out the invention is previously recorded in the inside of the apparatus, no limitation is made to this, and the same function may be downloaded from a network, or the same function is stored on a recording medium and may be installed in the apparatus. As the recording medium, any form may be used as long as the recording medium, such as a CD-ROM, can store the program and can be read by the apparatus. Besides, the function obtained previously by installation or download at stated above may be realized by the cooperation with an OS (Operating System) or the like in the inside of the apparatus.

Although the invention has been described with reference to the specific modes, it would be apparent for one of ordinary skill in the art that various modifications and improvements can be made without departing from the sprit and scope of the invention.

As described above in detail, according to the invention, in the image forming apparatus for transferring the toner image onto the sheet by applying the transfer bias voltage to the sheet through the transfer member, there can be provided the technique to prevent the occurrence of poor transfer by suitably controlling the transfer bias voltage according to the processing condition.

What is claimed is:

1. An image forming apparatus for transferring a toner image onto a sheet by applying a transfer bias voltage to the sheet through a transfer member, comprising:

a roughness information acquiring unit configured to acquire information relating to a surface roughness of the sheet;

a sheet information acquiring unit configured to acquire information relating to an electric resistance of the sheet;

an environment detecting unit configured to detect a humidity as an installation environment of the image forming apparatus;

a voltage calculating unit configured to calculate a transfer bias voltage based on the information acquired by the sheet information acquiring unit and the humidity detected by the environment detecting unit;

a voltage correcting unit configured to correct a voltage value of the transfer bias voltage calculated by the voltage calculating unit based on the information acquired by the roughness information acquiring unit, so that a transfer current flowing to the sheet at a time when the toner image is transferred onto the sheet becomes a specified optimum current value; and a voltage control unit configured to apply the transfer bias voltage of the voltage value corrected by the voltage correcting unit.

2. The image forming apparatus according to claim 1, wherein the voltage correcting unit performs a correction based on the information relating to the surface roughness of the sheet acquired by the roughness information acquiring unit, so that as a value of the surface roughness of the sheet becomes large, a post-correction value of the voltage value of the transfer bias voltage calculated by the voltage calculating unit becomes large.

3. The image forming apparatus according to claim 1, further comprising an operation input unit configured to receive an operation input of a user, wherein the roughness information acquiring unit acquires the information relating to the surface roughness of the sheet based on the operation input to the operation input unit.

4. The image forming apparatus according to claim 1, further comprising a roughness detecting unit configured to detect the surface roughness of the sheet, wherein the roughness information acquiring unit acquires a value of the surface roughness detected by the roughness detecting unit.

5. The image forming apparatus according to claim 1, wherein the sheet information acquiring unit acquires at least one of a model number, a thickness, a basis weight and a material of the sheet as the information relating to the electric resistance of the sheet.

6. An image forming apparatus for transferring a toner image onto a sheet by applying a transfer bias voltage to the sheet through a transfer member, comprising:

a roughness information acquiring unit configured to acquire information relating to a surface roughness of the sheet;

a sheet information acquiring unit configured to acquire information relating to an electric resistance of the sheet;

an environment detecting unit configured to detect a humidity as an installation environment of the image forming apparatus;

a resistance value information acquiring unit configured to acquire information relating to an electric resistance of the transfer member;

a first transfer voltage calculating unit configured to calculate a first transfer voltage as a voltage for the transfer member in the transfer bias voltage based on the information acquired by the resistance value information acquiring unit and a specified current value a second transfer voltage estimating unit configured to estimate a second transfer voltage as a voltage for the sheet in the transfer bias voltage based on the humidity detected by the environment detecting unit and the information acquired by the sheet information acquiring unit;

a voltage correcting unit configured to correct a voltage value of the second transfer voltage estimated by the second transfer voltage estimating unit based on the information acquired by the roughness information acquiring unit, so that a transfer current flowing to the sheet at a time when the toner image is transferred onto the sheet becomes a specified optimum current value; and a voltage control unit configured to apply, as the transfer bias voltage, a sum of the first transfer voltage calculated by the first transfer voltage calculating unit and the second transfer voltage of the voltage value corrected by the voltage correcting unit.

7. The image forming apparatus according to claim 6, further comprising a resistance value calculating unit configured to calculate an electric resistance value of the transfer member based on a voltage value at a time when a specified current is made to flow to the transfer member, wherein the resistance value information acquiring unit acquires the electric resistance value calculated by the resistance value calculating unit.

8. The image forming apparatus according to claim 6, further comprising a resistance value estimating unit configured to estimate an electric resistance value of the transfer member based on the humidity detected by the environment detecting unit, wherein the resistance value information acquiring unit acquires the electric resistance value estimated by the resistance value estimating unit.

9. The image forming apparatus according to claim 6, wherein the voltage correcting unit performs a correction based on the information relating to the surface roughness of the sheet acquired by the roughness information acquiring unit, so that as a value of the surface roughness of the sheet becomes large, a post-correction value of the voltage value of the second transfer voltage estimated by the second transfer voltage estimating unit becomes large.

10. The image forming apparatus according to claim 6, further comprising an operation input unit configured to receive an operation input of a user, wherein the roughness information acquiring unit acquires the information relating to the surface roughness of the sheet based on the operation input to the operation input unit.

11. The image forming apparatus according to claim 6, further comprising a roughness detecting unit configured to detect the surface roughness of the sheet, wherein the roughness information acquiring unit acquires a value of the surface roughness detected by the roughness detecting unit.

12. The image forming apparatus according to claim 6, wherein the sheet information acquiring unit acquires at least one of a model number, a thickness, a basis weight and a material of the sheet as the information relating to the electric resistance of the sheet.

13. An image forming apparatus for transferring a toner image onto a sheet by applying a transfer bias voltage to the sheet through a transfer member, comprising:

a roughness information acquiring unit configured to acquire information relating to a surface roughness of the sheet;

an environment detecting unit configured to detect a humidity and a temperature as an installation environment of the image forming apparatus;

a resistance value calculating unit configured to calculate an electric resistance value of the transfer member and the sheet based on a voltage value at a time when a specified current is made to flow to the sheet through the transfer member;

a transfer voltage calculating unit configured to calculate the transfer bias voltage based on the electric resistance value calculated by the resistance value calculating unit and the specified current;

a voltage correcting unit configured to correct a voltage value of the transfer bias voltage calculated by the transfer voltage calculating unit based on the information acquired by the roughness information acquiring unit, so that a transfer current flowing to the sheet at a time when the toner image is transferred onto the sheet becomes a specified optimum current value; and a voltage control unit configured to apply, in a case where the temperature and the humidity detected by the environment detecting unit indicates a specified high temperature and high humidity environment, a sum of a specified correction voltage value according to the temperature and the humidity and the voltage value corrected by the voltage correcting unit as the transfer bias voltage.

14. The image forming apparatus according to claim 13, wherein the voltage correcting unit performs a correction based on the information relating to the surface roughness of the sheet acquired by the roughness information acquiring unit, so that as a value of the surface roughness of the sheet becomes large, a post-correction value of the voltage value of the transfer bias voltage calculated by the transfer voltage calculating unit becomes large.

15. The image forming apparatus according to claim 13, further comprising an operation input unit configured to receive an operation input of a user, wherein the roughness information acquiring unit acquires the information relating to the surface roughness of the sheet based on the operation input to the operation input unit.

16. The image forming apparatus according to claim 13, further comprising a roughness detecting unit configured to detect the surface roughness of the sheet, wherein the roughness information acquiring unit acquires a value of the surface roughness detected by the roughness detecting unit.

17. An image forming apparatus for transferring a toner image onto a sheet by applying a transfer bias voltage to the sheet through a transfer member, comprising:

a roughness information acquiring unit configured to acquire information relating to a surface roughness of the sheet;

a sheet information acquiring unit configured to acquire information relating to an electric resistance of the sheet;

an optimum current value setting unit configured to set an optimum value of a transfer current at a time when the toner image is transferred onto the sheet based on the information acquired by the roughness information acquiring unit and the sheet information acquiring unit;

a voltage detecting unit configured to detect a voltage value at a time when the transfer current of the current value set by the optimum current value setting unit is made to flow to the sheet through the transfer member; and a voltage control unit configured to apply the transfer bias voltage of the voltage value detected by the voltage detecting unit.

18. The image forming apparatus according to claim 17, wherein the sheet information acquiring unit acquires at least one of a model number, a thickness, a basis weight and a material of the sheet as the information relating to the electric resistance of the sheet.

19. The image forming apparatus according to claim 17, further comprising an operation input unit configured to receive an operation input of a user, wherein the roughness information acquiring unit acquires the information relating to the surface roughness of the sheet based on the operation input to the operation input unit.

20. The image forming apparatus according to claim 17, further comprising a roughness detecting unit configured to detect the surface roughness of the sheet, wherein the roughness information acquiring unit acquires a value of the surface roughness detected by the roughness detecting unit.

* * * * *